US007374518B2

(12) United States Patent
Ratner

(10) Patent No.: US 7,374,518 B2
(45) Date of Patent: May 20, 2008

(54) COLLAPSIBLE ROTARY TORSO EXERCISE MACHINE

(76) Inventor: Jeffrey Bruce Ratner, 6479 90th Ave. North, Pinellas Park, FL (US) 33782

( * ) Notice: Subject to any disclaimer, the term of this patent is extended or adjusted under 35 U.S.C. 154(b) by 0 days.

(21) Appl. No.: 11/205,444

(22) Filed: Aug. 16, 2005

(65) Prior Publication Data

US 2007/0042880 A1 Feb. 22, 2007

(51) Int. Cl.

| | |
|---|---|
| ***A63B 21/00*** | (2006.01) |
| ***A63B 21/008*** | (2006.01) |
| ***A63B 21/012*** | (2006.01) |
| ***A63B 21/04*** | (2006.01) |

(52) U.S. Cl. ..... 482/136; 482/111; 482/114; 482/130; 482/140

(58) Field of Classification Search ..... 482/72–3, 482/111–3, 133–7, 140, 125–7, 130, 142, 482/118

See application file for complete search history.

(56) References Cited

U.S. PATENT DOCUMENTS

| | | | | |
|---|---|---|---|---|
| 4,456,245 | A * | 6/1984 | Baldwin | 482/136 |
| D281,712 | S | 12/1985 | Stedman | |
| 4,687,197 | A * | 8/1987 | Larsson et al. | 482/73 |
| 4,733,860 | A * | 3/1988 | Steffee | 482/136 |
| 4,979,736 | A * | 12/1990 | Maynard | 482/137 |
| 5,052,684 | A * | 10/1991 | Kosuge et al. | 482/118 |
| D344,993 | S | 3/1994 | Laratta | |
| 5,391,130 | A * | 2/1995 | Green et al. | 482/71 |
| 6,022,303 | A * | 2/2000 | Abdo | 482/140 |
| 6,248,047 | B1 * | 6/2001 | Abdo | 482/130 |
| 6,726,608 | B1 | 4/2004 | Hsu | |
| 6,918,861 | B2 * | 7/2005 | Liao et al. | 482/57 |
| 6,964,636 | B2 * | 11/2005 | Verheem et al. | 482/121 |
| 7,108,642 | B1 * | 9/2006 | Stearns | 482/140 |
| 7,125,365 | B2 * | 10/2006 | Krietzman | 482/112 |
| 2003/0092546 | A1 * | 5/2003 | Yu | 482/142 |
| 2003/0130093 | A1 * | 7/2003 | Giglio | 482/51 |

* cited by examiner

*Primary Examiner*—Loan H. Thanh
*Assistant Examiner*—Allana Lewin
(74) *Attorney, Agent, or Firm*—Emanuel Morgenstern

(57) ABSTRACT

The construction of a collapsible rotary torso exercise machine is disclosed. The machine's extended parts fold down and/or detach so that it may be stored in a small space. The machine is also lightweight and therefore portable. Three different types of resistance mechanism are specifically disclosed: 1) piston in cylinder resistance 2) friction resistance and 3) elastic member resistance. The collapsible rotary torso exercise machine preferably has variable resistance and for each type of resistance mechanism disclosed, a mechanism or method for varying the resistance is also disclosed.

20 Claims, 16 Drawing Sheets

COLLAPSIBLE ROTARY TORSO EXERCISE MACHINE

BACKGROUND OF THE INVENTION (1) Field of Invention

This invention relates to the field of rotary torso exercise machines.

(2) Description of Prior Art

Rotary torso exercise machines are known in the art. U.S. Pat. No. 4,456,245 discloses an exercise machine designed to provide the user with a means to exercise torso rotation muscles. This machine provides means to vary the resistance to the torso rotation exercise via weights connected to a pulley and cam mechanism. However the machine is quite large and extremely heavy and is therefore primarily suited for use only in a commercial gym or in the largest, most expensive home exercise rooms, its space and budget requirements putting it well beyond the means of the average consumer desiring to purchase a rotary torso exercise machine for home use.

U.S. Pat. No. 5,052,684 discloses another apparatus for training the waist portion of the body. This machine features upper and lower portions, engaged with one another by a drive chain and sprockets, and which turn in opposite directions from one another to accomplish the twisting exercise motion. Brakes are provided as a means for variable resistance to the exercise motion. Though the machine is considerably less bulky than that disclosed in U.S. Pat. No. 4,456,245, and would be suitable for home use, it does not offer collapsibility for ready storage in a small space.

U.S. Pat. No. 6,726,608 B1 discloses a rotary torso exercise machine as well. According to the inventor, its purpose is to assist in stimulating the acupuncture points along the spine simply by allowing the user to twist the body in the rotary manner. Its size makes it suitable for home use however no means of external resistance is provided whatsoever and so resistance (strength) training of the rotary torso muscles cannot be accomplished using the device. Further, it does not offer collapsibility for ready storage in a small space.

U.S. Pat. No. 6,248,047 B1 discloses an exercise device for strengthening the abdominal and lower back muscles. It utilizes an elongated resilient spring member to provide resistance to exercise motions. Although a limited degree of rotary torso exercise could be accomplished using this device, it is not primarily designed to isolate this motion and would certainly be an inefficient way to exercise the torso rotary motion. As the only resistance provided by this machine is in relation to the deviation of the handlebar from the central neutral position, the machine cannot offer resistance to exercise through the full range of rotary torso motion. Further no means for adjusting the quantity of resistance offered is provided.

U.S. Pat. No. Des. 281,712 discloses the ornamental design for a torsion exercising apparatus apparently using two piston in cylinder assemblies for resistance. It appears to be suitable for home use but has no collapsibility features for storage. Similarly, U.S. Pat. No. Des. 344,993 discloses an ornamental design for a torso exercise machine. It also appears to be suitable for home use but likewise has no collapsibility features for storage in small spaces.

The purpose of the present invention is to provide a collapsible rotary torso exercise machine which offers resisted exercise through a full 90 degree range of torso rotation from 45 degrees clockwise orientation to 45 degrees counterclockwise orientation and vice versa. It is also the purpose of this invention to provide such a rotary torso exercise machine which features variable resistance. It is a further purpose of the present invention to provide such a rotary torso exercise machine which can be stored in a small space, is lightweight and readily portable, and which can be manufactured inexpensively enough so as to be within the budget of the average consumer. The present invention is thus ideally suited for home use where both space and monetary concerns are common issues.

(3) BRIEF DESCRIPTION OF THE DRAWINGS

(4) REFERENCE NUMERALS IN DRAWINGS

Figure 1:
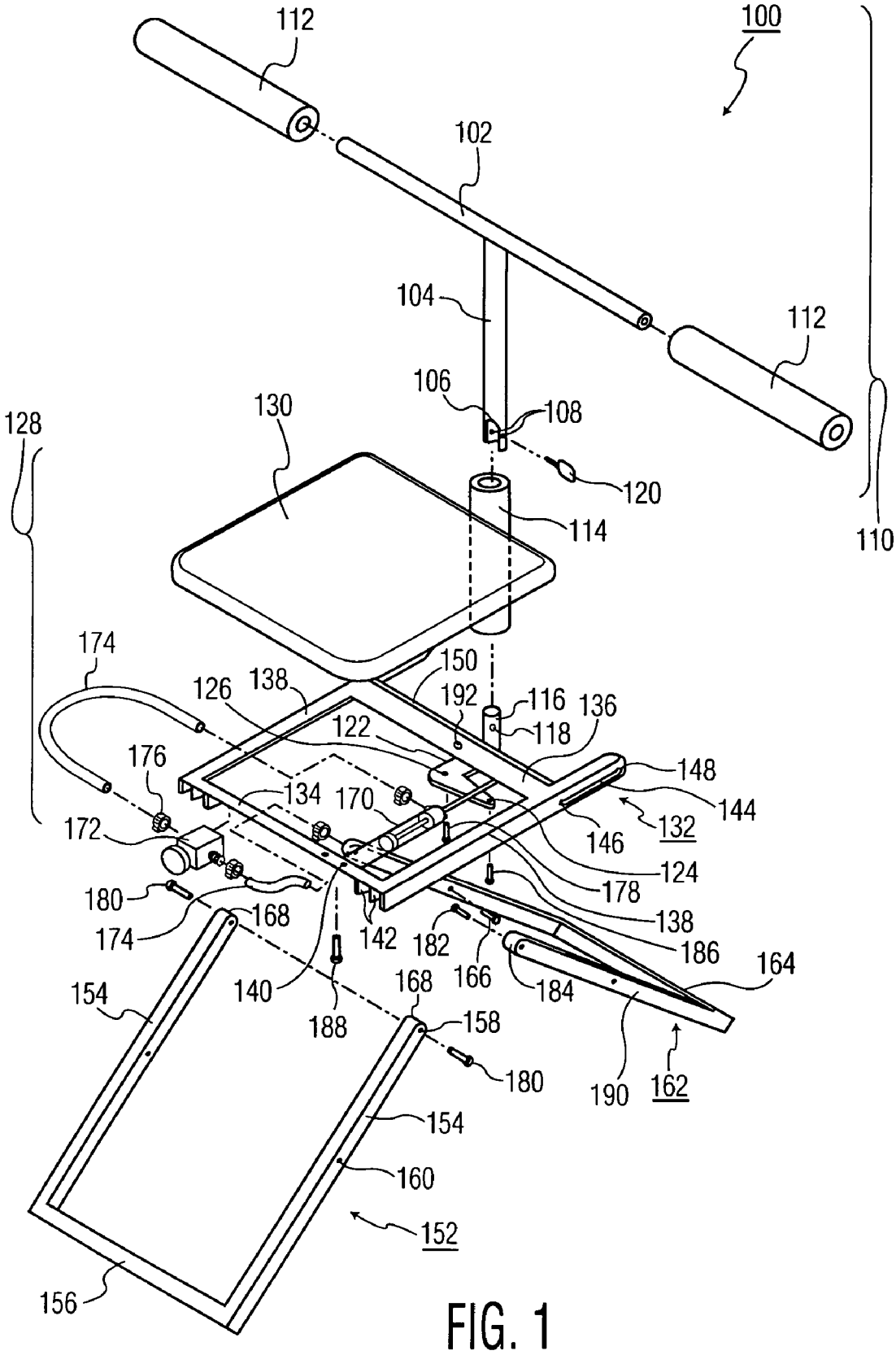
FIG. 1 shows an exploded view of an example of a piston in cylinder resistance embodiment of the collapsible rotary torso exercise machine.

100 Piston in cylinder resistance embodiment of the collapsible rotary torso exercise machine
102 Horizontal bar
104 Upper vertical post
106 Fold-down gap at bottom of upper vertical post
108 Lower vertical post attachment hole in upper vertical post
110 T-bar assembly
112 Horizontal bar foam pad
114 Vertical post foam pad
116 Lower vertical post
118 Upper vertical post attachment hole in lower vertical post
120 Vertical post release pin
122 Piston in cylinder resistance embodiment rotational member
124 Clevis attachment hole
126 Rotation pin hole
128 Seat portion
130 Seat
132 Piston in cylinder resistance embodiment frame
134 Frame front crossbar section
136 Frame rear crossbar section
138 Frame sidebar section
140 Cylinder attachment hole
142 Leg attachment protrusion
144 Front leg pin slot
146 Extended-leg pin-locking inlet
148 Collapsed-leg pin-locking inlet
150 Upward curving lip on rear crossbar section of frame
152 Front leg
154 Side section of 'U' of front leg
156 Base of 'U' of front leg
158 Upper pin attachment hole
160 Lower pin attachment hole
162 Rear leg
164 Base of 'U' of rear leg
166 Leg-to-leg attachment pins
168 Upper end of front leg
170 Cylinder
172 Resistance adjustment valve
174 High pressure hydraulic hose
176 Hose clamp
178 Rotation pin
180 Front leg frame attachment pin
182 Rear leg frame attachment pin
184 Upper end of rear leg
186 Rotational member attachment pin
188 Front crossbar attachment pin
190 Side section of 'U' of rear leg
192 Rotational member attachment hole in rear crossbar
202 Rear leg attachment holes
204 Horizontal surface of sidebar
206 Vertical surface of sidebar
302 Valve attachment hole
304 Valve body
306 Valve core
308 Valve plug
310 Valve-core 0-ring
312 Valve plug 0-ring
314 Hose barb
316 Frame attachment hole
318 Interior cylindrical bore of valve
320 Front crossbar attachment screw
322 Resistance adjustment knob
324 Teardrop-shaped hole in valve core
326 Valve core O-ring groove
400 Variable resistance piston in cylinder resistance mechanism
402 Cylinder endcap
404 Hose barb
406 Piston
408 Piston seal
410 Piston rod
412 Piston rod seal
414 Clevis
416 Rotational member attachment hole
418 Frame attachment protrusion
420 Frame attachment hole
422 Hydraulic fluid
424 Front chamber of cylinder
426 Rear chamber of cylinder
1100 Friction resistance embodiment of collapsible rotary torso exercise machine
1102 Frame of friction resistance embodiment
1104 Rotational member of friction resistance embodiment
1106 Resistance mechanism of friction resistance embodiment
1108 Resistance adjustment mechanism of friction resistance embodiment
1206 Cylindrical portion of drum-shaped rotational member
1208 Lower flange of drum-shaped rotational member
1210 Upper flange of drum-shaped rotational member
1212 Wedge shaped cutout
1214 Frame attachment hole in lower flange
1216 Boss hole in upper flange
1218 Lower vertical post attachment hole in rotational member
1220 Spoke
1222 Boss on rear crossbar
1224 Rear crossbar on frame
1226 Rotational member attachment hole
1228 Rotation pin
1232 Friction resistance band
1234 Friction resistance band pin attachment loop
1236 Friction band lining
1238 Friction band tension adjustment bracket
1240 Guide pin hole in friction band tension adjustment bracket
1242 Tension adjustment knob attachment hole
1244 Friction band attachment holes
1246 Front crossbar section of frame
1248 Friction band adjustment bracket attachment protrusion
1250 Guide pin hole in frame
1252 Tension adjustment knob hole
1254 Tension adjustment knob
1256 Guide pin
1258 Band pin
1260 Seat attachment hole in frame
1300 Elastic member resistance embodiment of the collapsible rotary torso exercise machine
1302 Frame for elastic member resistance embodiment
1306 Rotational member for elastic member resistance embodiment
1308 Elastic member/Resistance mechanism for elastic member resistance embodiment
1402 Lower plate of rotational member
1404 Upper plate of rotational member
1406 Plate alignment pin
1408 Lower plate alignment pin protrusion
1410 Lower plate alignment pin hole

1412 Frame attachment hole in lower plate
1414 Elastic member attachment pin hole on rotational member
1416 Frame attachment hole in upper plate
1418 Upper plate alignment pin protrusion
1420 Upper plate alignment pin hole
1422 Lower vertical post attachment hole
1424 Boss on rear crossbar
1426 Rear crossbar
1428 Rotational member attachment hole
1430 Rotation pin
1438 Front crossbar of frame
1440 Elastic member attachment protrusion on front crossbar
1442 Elastic member pin attachment hole on frame
1444 Elastic member attachment pin
1446 Seat attachment holes

(5) SUMMARY OF THE INVENTION

The present invention is a collapsible rotary torso exercise machine. The machine comprises a seat portion, collapsible legs, a substantially horizontally rotating rotational member, a T-bar assembly comprising a substantially horizontal bar portion and a substantially vertical post portion which is foldable and/or removably attached to the rotational member, and a resistance mechanism which engages the rotational member and provides resistance to rotary motion of the rotational member and attached T-bar assembly. The machine also preferably includes a mechanism or means for varying the resistance of the resistance mechanism although the machine can readily be made without multiple resistance settings if desired.

(6) DETAILED DESCRIPTION OF THE INVENTION

A) General Description

The collapsible rotary torso exercise machine comprises a seat portion, collapsible legs, a horizontally rotating rotational member, a T-bar assembly comprising a substantially horizontal bar and a substantially vertical post which is foldable and/or removable from the rotational member, and a resistance mechanism. It also preferably includes a mechanism or means for varying the resistance of the resistance mechanism.

A key feature of the present invention is its collapsibility for easy storage in a small space. The legs of the machine may be locked in position for use but readily collapse for storage purposes. The T-bar assembly folds down or is alternatively readily detachable for storage or shipping. The various resistance mechanisms disclosed attach to the underside of the seat portion and require little vertical space so the collapsed machine is quite compact and may be easily stored in minimal space. In the embodiments disclosed below, while the T-bar assembly remains attached to the rotational member, the entire machine folds and collapses down to a height of less than 5 inches. Once the T-bar assembly is removed from the rest of the machine, the remainder of the machine folds down to a height of less than 4.25 inches (though the great majority of the remainder of the machine folds down to a height of 2.375 inches). Since the collapsible rotary torso exercise machine is relatively lightweight and folds down to such a small size, it is therefore readily portable.

The collapsible legs preferably attach to the underside of the seat portion and are designed to lock into extended position for use of the machine and to fold down for storage when the machine is not in use. In the embodiments specifically disclosed below, the front leg frame attachment pins, which attach the tops of the front leg to pin slots located toward the rear of the frame sidebars, disengage from pin-locking inlets in their respective pin slots, allowing the tops of the front leg to slide rearward and the crisscrossing front and rear legs to fold down against the underside of the frame. Other folding methods are possible but the method utilized here yields a sturdy yet compact result. Alternatively, the legs could be designed to readily detach from the machine for storage and to be readily reattached for use of the machine. However an arrangement with detachable legs is less desirable as more work is required for setting up and dismantling the machine.

It is also feasible to construct a device without legs at all where the seat portion rests directly on the floor during use. Alternatively very short legs or a frame could support the seat so as to leave sufficient space beneath the seat for the resistance mechanism to be housed, the seat portion then resting just slightly above the floor and also yielding a very compact design which allows for easy storage. This design would alter the body positions possible while using the machine, the user being required to stretch his/her legs out horizontally or to bend the legs in ways that may be less desirable for accomplishing the rotary torso exercise.

The seat portion of the machine in the examples below is a substantially square flat piece of solid polypropylene resting upon a substantially square aluminum frame. However the present invention is not meant to be limited to seat portions of this description as any suitable seat portion may be utilized. The seat portion need not be made from these particular materials, nor constructed of a separate seat attached to a frame, nor limited to the substantially flat square shape or size specified below. Any suitable materials, including padded materials, any suitable number of parts, including single-part construction, and any suitable desired shape or size, including rounded or irregular shapes or shapes designed to contour to the human physique, may be utilized so long as adequate support and appropriate attachment sites for the various connected components of the machine are afforded.

The T-bar assembly comprises a substantially horizontal bar and a substantially vertical post which is foldable and/or removable from the rotational member. In the examples given below, the vertical post comprises 2 parts (an upper vertical post and a lower vertical post) and is both foldable and removable from the rotational member. Both the horizontal bar and vertical post are made of substantially straight cylindrical lengths of (solid or hollow) aluminum of specific sizes and are welded to each other in the disclosed embodiments. However, though the disclosed embodiments of the machine utilize substantially straight cylindrical aluminum horizontal bars and vertical posts of particular sizes and numbers of components, the invention is not meant to be limited to this design. These bars may be made of any suitable material and in any suitable size and the horizontal bar and vertical post may be attached together in any suitable way that will allow them to accomplish the desired purpose. Further, these bars may be suitably contoured in some respects or may be constructed of a different number of components (including one part T-bar construction) than in the examples below without affecting the essential function of the machine.

Both the horizontal bar and vertical post are preferably covered with foam padding for comfort and to cushion the flesh of the user against bruising or other injury when these pieces are engaged for exercise. However, the invention is not meant to be limited to the use of foam padding for this purpose. Any suitable padding material may be utilized to accomplish this purpose or, if desired, the machine can be constructed with no padding at all.

A substantially horizontally rotating rotational member links the T-bar assembly to the seat portion and to the resistance mechanism. Three different shapes of aluminum rotational member are disclosed in the embodiments specifically disclosed below: 1) a flat boomerang or L-shaped rotational member, 2) a substantially disc-shaped rotational member and 3) a substantially cylindrical rotational member. In the case of the boomerang/L-shaped rotational member, the center of the elbow of the boomerang/L-shaped member is fastened to the rear underside of the seat portion via a rotation pin such that the rotational member can rotate freely in the horizontal plane around this rotation pin. In the cases of the disc-shaped or cylindrical rotational members, the center of the disc or circular face of the cylinder is likewise fastened to the rear underside of the seat portion via a rotation pin such that the rotational member can rotate freely in the horizontal plane around this pin. In each case, the 'center' of the rotational member is thus fastened to the underside of the seat portion such that the rotational member can rotate freely in a substantially horizontal plane. Though only these few designs of rotational member are disclosed in the embodiments below, the invention is not meant to be limited to only these shapes of rotational members or to rotational members made of aluminum. Many shapes of rotational member can be successfully utilized in creating embodiments of the present invention and the rotational member may be made of any suitable material. Further, though a rotation pin is used to fasten the rotational member to the rear underside of the seat portion in the examples below, the rotational member may be fastened to any suitable site on the machine via any suitable means without changing the nature of the invention.

The vertical post of the T-bar assembly is fastened to the substantially horizontally oriented rotational member so that the rotational member and attached T-bar assembly can rotate substantially horizontally in an arc around the rotation pin which fastens the rotational member to the seat portion of the machine. In the case of the boomerang/L-shaped rotational member, the bottom of the vertical post is fastened toward the end of one arm of the boomerang/L-shaped rotational member while in the case of the disc-shaped and cylindrical rotational members, the vertical post is fastened near the circumference of the disc-shaped surface of the rotational member. In the embodiments disclosed below, the vertical post is fastened to the rotational member approximately 4.25 inches from the rotation pin so as to guide the exercise motion into the path of the natural rotary torso motion of the body. However the invention is not meant to be limited to this exact arrangement as the vertical post may be fastened at any suitable distance from the rotation pin (or other axis of rotation depending upon design), yielding a different exercise arc, although distances ranging from 0 to 12 inches would likely be considered preferable given the mechanics and size range of the human body.

In the embodiments disclosed below, the foldable/detachable vertical post is made up of two vertical post sections (an upper vertical post and a lower vertical post) held together by a vertical post release pin. The upper vertical post is a hollow aluminum tube with a cutout fold-down gap on one side of its lower end. The lower vertical post is a solid cylindrical aluminum piece with a rounded top. The post release pin penetrates the lower end of the upper vertical post and the upper end of the lower vertical post through upper and lower vertical post attachment holes, thereby connecting the upper and lower vertical posts together. This post pin, when engaged, acts as a hinge, allowing the upper vertical post to fold down towards the seat in the direction of the cutout fold-down gap at its lower end. Though the vertical post is free to fold down in the disclosed embodiments, during exercise it is held upright by the pressure of the user's back against the T-bar assembly. The pin may alternatively be disengaged allowing upper vertical post to be detached from the lower vertical post for storage or shipping if desired. In the examples below, the bottom end of the lower vertical post is welded to the rotational member.

Though the above design utilizes a 2-part foldable/detachable vertical post of certain specifications, the invention is not meant to be limited to this design for vertical posts. Other suitable designs and sizes of vertical posts, including vertical posts of adjustable length, vertical posts that are foldable but not detachable, vertical posts that are only detachable but not foldable, vertical posts that lock in place when extended, vertical posts comprising a different number of components, etc., may be successfully utilized in constructing embodiments of the present invention. Further, since in the embodiments specifically disclosed below the lower vertical post is a relatively short length of material welded to the rotational member, one can alternatively view it as part of the rotational member. In this view what has been called the upper vertical post would be seen as the whole of the vertical post which would be foldably/removably attached via the vertical post release pin directly to the rotational member itself.

The rotational member is also connected to and/or engages the resistance mechanism. In the case of the boomerang/L-shaped rotational member, the resistance mechanism engages near the end of the second arm of the rotational member at approximately a 90 degree horizontal arc around the rotation pin from the vertical post (which is attached to the first arm of the rotational member). In the case of the friction resistance embodiment, the rotational member is a cylindrical drum. The friction resistance band engages the cylindrical surface of the rotational member around more than 180 degrees of its circumference. In the case of the elastic member resistance embodiment, two stacked and fastened disc-shaped plates make up the rotational member. The resistance mechanism (i.e. the elastic member) is engaged near the circumference of the rotational member at approximately 90 degrees of horizontal arc from where the vertical post attaches to the rotational member.

In each case, the function of the rotational member is essentially the same. Taken together with the vertical post (or T-bar assembly), the rotational member essentially functions as a crank in the machine, the vertical post (or T-bar assembly) functioning as the handle of the crank. However the method of engagement of the resistance mechanisms in the different examples as well as the resistance characteristics produced by the various resistance mechanisms vary somewhat.

Three different types of resistance mechanisms are specifically disclosed: 1) piston in cylinder resistance 2) friction resistance and 3) elastic member resistance (including various types of rubber bands and springs as well as other elastic members). However the invention is not meant to be limited to these specific types of resistance mechanisms or to the specific resistance designs disclosed below. Other types of resistance mechanism besides those specifically disclosed may be suitable to construct other embodiments of the present invention. For example, multiple 'piston in cylinder' assemblies may be utilized rather than the single piston in cylinder assembly utilized in the example of a piston in cylinder resistance embodiment illustrated below. Although the friction resistance embodiment illustrated below utilizes a band brake as the friction resistance mechanism, other friction mechanisms including caliper-type brakes, drum-type brakes, etc. may also be successfully employed to create other friction resistance embodiments of the present invention. As further examples, resilient rods or bows that offer resistance to being bent or torsion rods could also be employed as the basis of resistance mechanisms but design modifications would be necessary.

Each of the disclosed resistance mechanisms also offers means for adjusting the quantity of the machine's resistance to the rotary torso exercise. In the case of the piston in cylinder embodiment, resistance may be adjusted via a resistance adjustment knob connected to a valve which regulates the flow of fluid (liquid or gas) between the front and rear chambers of the cylinder. In the case of the friction resistance (band brake) embodiment disclosed below, resistance may be adjusted via a resistance adjustment knob which controls the tension of the friction resistance band against the cylindrical surface of the drum-shaped rotational member. In the case of the elastic member resistance embodiment, resistance may be adjusted by interchanging, adding or subtracting various elastic members. Though the several methods of resistance adjustment mentioned above are the only ones specifically disclosed herein, the invention is not meant to be limited to these specific resistance adjustment mechanisms or designs. Any suitable method or design for resistance adjustment, such as, e.g., pinch valves or needle valves for the piston in cylinder embodiment, alternate elastic member attachment points or other tension adjustment mechanisms for the elastic member resistance embodiment, etc., may be successfully utilized in creating other embodiments of the present invention.

To perform rotary torso exercise using the various embodiments of the machine, the user sits on the seat portion preferably with feet flat on the floor and back against the T-bar assembly. The arms are hooked over the horizontal bar such that the crooks of the elbow engage the horizontal bar. By twisting from side to side in a rotary motion the T-bar assembly together with the rotational member are rotated in a horizontal arc around the rotation pin thereby cranking the rotational member and engaging the resistance mechanism to resist the torso rotary motion. This arc allows the torso to twist in a natural rotary motion rotating horizontally around the axis of the spine and providing resisted exercise for the oblique muscles as well as other muscles involved in torso rotary motion. The variable resistance mechanism or means for varying resistance allow the user to choose the desired amount of resistance to the rotary torso exercise. The user's weight upon the seat portion of the device combined with the friction of the machine's legs upon the floor provide the necessary counterforce and stabilization of the machine to allow for rotary torso exercise with resistance to be performed though the machine is light in weight.

In the piston in cylinder and friction resistance embodiments, a user may accomplish any number of continuous repetitions of 90 degrees of positively resisted exercise back and forth from 45 degrees clockwise torso rotation to 45 degrees counterclockwise rotation and vice versa without any need for resetting or readjusting the machine. In each of these embodiments resistance may be varied via a resistance adjustment knob which is easily accessible to the user while seated on the device. In the piston in cylinder embodiment, the resistance adjustment knob affects a valve which controls the fluid (liquid or gas) flow through the cylinder and accompanying hoses, thereby controlling the resistance given by the piston in cylinder resistance mechanism. In the specific embodiment of friction resistance illustrated, the adjustment knob loosens or tightens a friction resistance band against a drum-shaped rotational member, thereby varying the resistance given to rotary motion of the rotational member and attached T-bar assembly.

In the elastic member resistance embodiment disclosed, a user may accomplish any number of successive repetitions of 90 degrees of positively resisted exercise in only one orientation at a time (either from 45 degrees of clockwise torso rotation to 45 degrees of counterclockwise torso rotation or from 45 degrees of counterclockwise torso rotation to 45 degrees of clockwise torso rotation) without resetting the resistance mechanism. By resetting the machine through removal of a pin, turning the 2 plates which comprise the disc-shaped rotational member to new positions and reinserting the pin, positively resisted exercise in the opposite orientation may then be accomplished. Incremental variable resistance is also provided in the example of an elastic member resistance embodiment below but requires removal, adding or replacing of various elastic members to accomplish the changes in quantity of resistance.

Although an elastic member resistance embodiment of the collapsible rotary torso exercise machine may require additional manipulation of the components to alternate between positively resisted exercise in both clockwise and counterclockwise orientations, an added benefit offered by this embodiment stems from the fact that the elastic member will continue to provide resistance in one direction only from the time the user begins the exercise motion in the currently selected orientation of exercise until the user returns to the exercise starting position for that orientation of exercise. This allows for negative resistance exercise to be accomplished as the user returns to the starting position for the given orientation of exercise whereas the piston in cylinder resistance and friction resistance embodiments mentioned above are designed to offer only positive resistance against the current direction in which the user is turning the body.

Though not specifically disclosed below, the machine may also optionally include any of a number of available mechanisms for counting the number of repetitions of exercise and/or gauges, for measuring the degree of torso rotation accomplished during each exercise or for displaying the current resistance setting and/or force expended by the user.

B) Specific Embodiments

Piston in Cylinder Resistance Embodiment

Referring to FIG. 1, there is shown an exploded view of an embodiment of a collapsible portable rotary torso exercise machine with piston in cylinder resistance.

The horizontal bar (102) is an aluminum rod one inch in diameter and 30 inches long. The upper vertical post (104) is an aluminum tube with an outer diameter of 1.25 inches, an inner diameter of 1 inch and a length of 16.5 inches. The lower end of the upper vertical post has a fold-down gap (106) which is a lengthwise cutout section 2.5 inches long, and 1 inch wide with a rounded top. There is a lower vertical post attachment hole (108), 0.25 inches in diameter, made horizontally through each side of the upper vertical post (104) located 2 inches from the bottom end of the upper vertical post (104). The horizontal bar (102) is welded at the middle of its length to the top of the vertical post (104) to form the T-bar assembly (110).

The horizontal bar foam pads (112) are cylindrical foam rubber tubes, 2.5 inches outer diameter, 1 inch inner diameter and 13.5 inches in length. One horizontal bar foam pad (112) is slid onto each end of the horizontal bar (102), one on either side of the attachment to the vertical post (104). The vertical post foam pad (114) is a foam rubber tube, 2.5 inches outer diameter, 1.25 inches inner diameter and 11 inches in length. The vertical post foam pad (114) is slid onto the upper vertical post (104).

The lower vertical post (116) is an aluminum rod 1 inch in diameter and 3.5 inches in length. It has a rounded top and a flat bottom. There is an upper vertical post attachment hole (118), 0.25 inches in diameter made from side to side through the diameter of the lower vertical post (116) and located 0.5 inches from the upper end of the lower vertical post (116).

The vertical post release pin (120) is a steel pin, 0.25 inches in diameter and 2 inches long with a 1 inch diameter ring attached to its end. The bottom end of the upper vertical post (104) is slid over the top end of the lower vertical post (116) until the lower vertical post attachment holes (108) in the upper vertical post (104) align with the upper vertical post attachment hole (118) in the lower vertical post (116). The vertical post release pin (120) is inserted through the upper and lower post attachment holes (108,118) to secure the upper and lower vertical posts (104,116) together.

The piston in cylinder resistance embodiment rotational member (122) is a boomerang-shaped flat aluminum piece 0.25 inches thick, one arm of the boomerang being 6 inches in length and tapering from 2 to 1.5 inches in width, and the second arm being 5.5 inches in length and tapering from 1.8 to 0.5 inches in width. The lower vertical post (116) is welded to the top side of the rotational member (122) near the end of the first arm of the boomerang, the attachment centered 0.75 inches from the end of that arm. A clevis attachment hole (124), 0.25 inches in diameter, is centered 0.25 inches from the end of the second arm of the rotational member (122) and a rotation pin hole (126), 0.25 inches in diameter, is located at the center of the elbow of the rotational member (122).

The seat portion (128) of the exercise machine comprises a polypropylene seat (130) attached to an aluminum frame (132). The frame (132) is a continuous piece made of 0.125 inch thick aluminum. (The frame (132) may be manufactured from one continuous piece of material or from several separate pieces which are welded or otherwise solidly joined together to form one continuous unit.) Its structure includes a front crossbar section (134), a rear crossbar section (136) and 2 sidebar sections (138).

The front crossbar section (134) is a length of aluminum 18 inches long and 1 inch wide. There is one 0.25 inch diameter cylinder attachment hole (140) located at 4.75 inches from the right end of the front crossbar (134). The front crossbar section (134) has 4 leg attachment protrusions (142) 1 inch wide and 1 inch long, jutting out from its underside parallel to the vertical portion of the frame sidebars (138) located at 1.187 inches and 2.312 inches from its ends.

Figure 2:
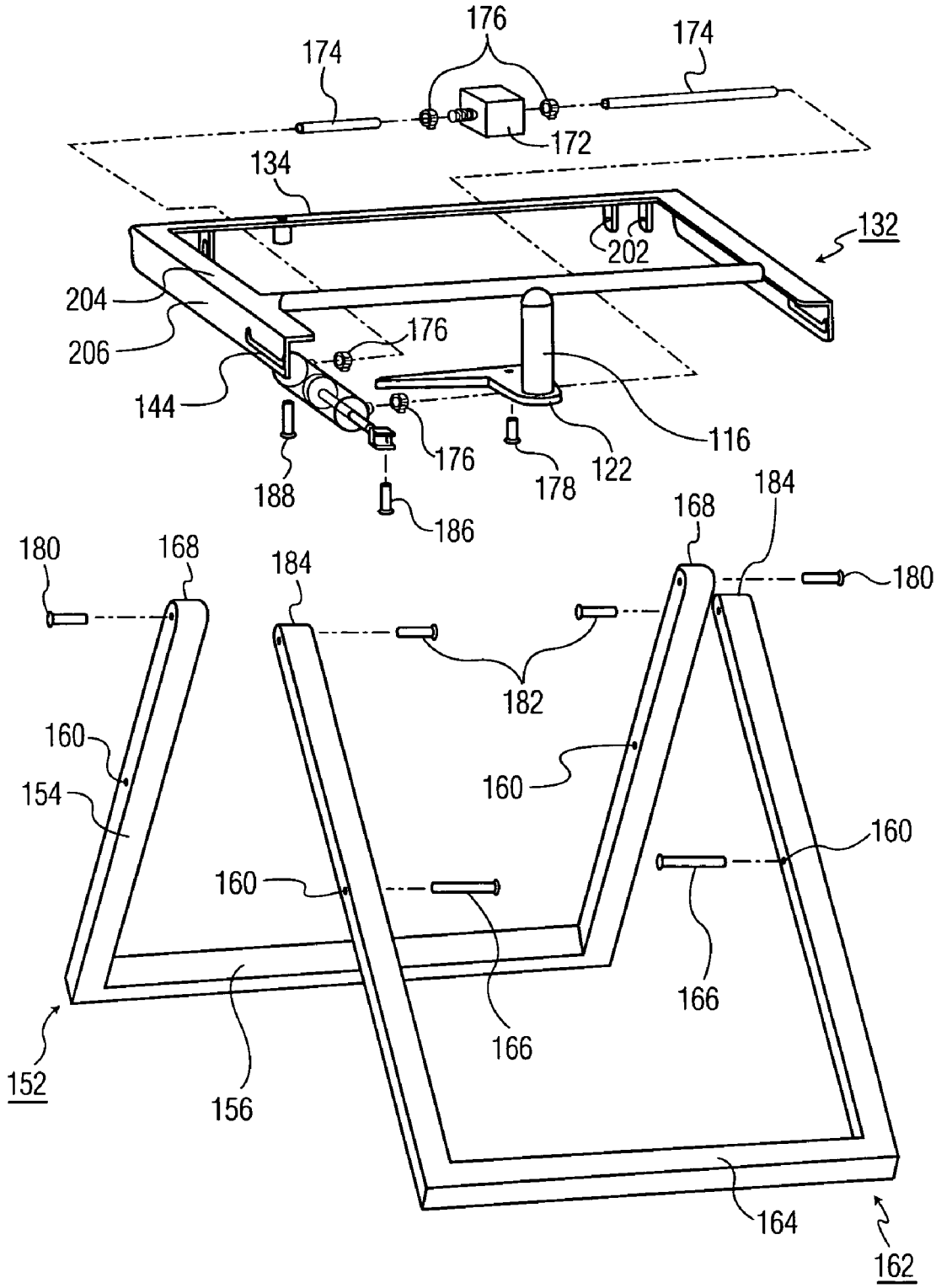
FIG. 2 shows an exploded view of the collapsible legs, frame, resistance mechanism, and rotational member of a piston in cylinder resistance embodiment of the collapsible rotary torso exercise machine.

Referring to FIG. 2, there is shown a rear exploded view of the collapsible base, rotational member and resistance mechanism of an example of a piston in cylinder resistance embodiment of a collapsible rotary torso exercise machine. The leg attachment protrusions (142) have 0.25 inch diameter leg attachment holes (202) through their centers.

Figure 3:
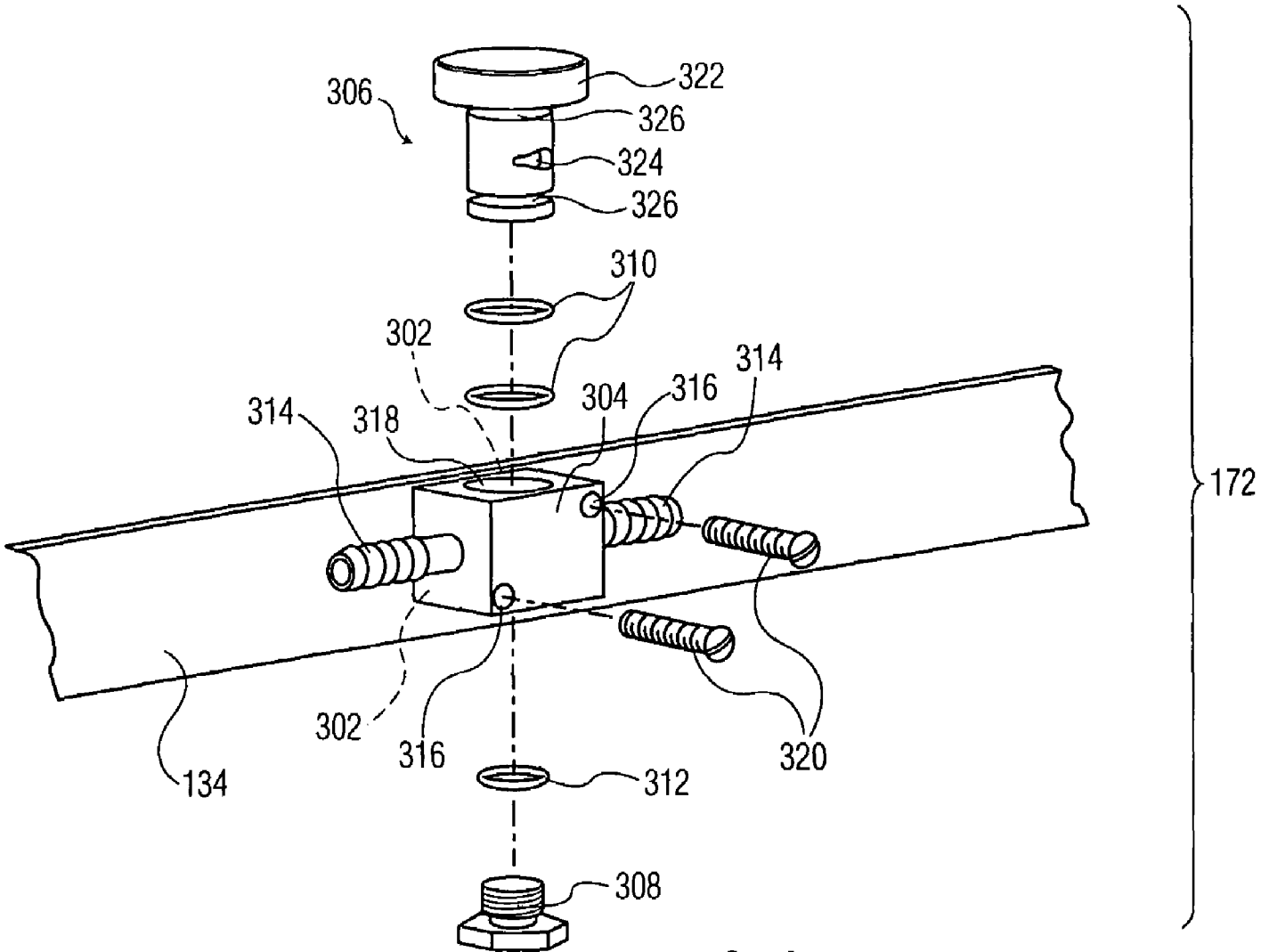
FIG. 3 shows an exploded view of an example of a resistance adjustment valve for a piston in cylinder resistance embodiment of the collapsible rotary torso exercise machine.

Referring to FIG. 3, there is shown an exploded view of the resistance adjustment valve of an example of a piston in cylinder embodiment of the collapsible rotary torso exercise machine. The front crossbar (134) has two #8-32 threaded valve attachment holes (302) located at 6.485 inches and 7.265 inches from its left end (when viewed from the front).

Referring back to FIGS. 1 and 2, the 2 frame sidebars (138) are 21.5 inches long. Referring to FIG. 2, each sidebar (138) is bent at a right angle at its middle along its length so there is a 1 inch wide horizontal surface (204) adjoining a 1.375 inch wide downward pointing vertical surface (206), the vertical surface (206) being located along the outer edge of the frame (132). The front end of the horizontal surface (204) of each sidebar (138) joins the ends of the front crossbar (134) at right angles in the horizontal plane to form a continuous horizontal surface.

Each sidebar (138) has a front leg pin slot (144), 5.375 inches long and 0.25 inches wide located along the length of the vertical surface (206) of the sidebar (138) positioned 0.25 inches from the lower edge of the vertical surface (206) of the sidebar and beginning approximately 0.25 inches from the rear end of the sidebar (138). The front leg pin slot (144) curves sharply upward at both of its ends to form an extended-leg pin-locking inlet (146) at its front end and a collapsed-leg pin-locking inlet (148) at its rear end.

The rear crossbar section (136) of the frame is 16 inches long and 2.125 inches wide horizontally. It has a 0.5 inch wide upward curving lip (150) along its back edge. The ends of the rear crossbar (136) connect at right angles in the horizontal plane with the horizontal surfaces (204) of the sidebars (138) at 5.375 inches from the rear ends of the sidebars (138) to form a continuous horizontal surface. The rear crossbar section (136) has a rotation pin attachment hole (192) centered along its length and 1.625 inches from the rear of the upward turned lip.

The rotation pin (178) is a 0.663 inch long, 0.25 inch diameter unthreaded pin with 0.5 inch diameter head. The rotational member (122) is attached to the rear crossbar section (136) of the frame (132) via the rotation pin (178) which is inserted through the rotation pin hole (126) in the rotational member (122) and into the rotation pin attachment hole (192) in the rear crossbar section (136) of the frame (132).

The four sections of the frame (132), i.e. the front crossbar (134), the sidebars (138), and the rear crossbar (136), have 0.25 inch diameter seat attachment holes (not shown for this embodiment but see 1260,1446 in FIGS. 12 and 14) through them at intervals along the lengths of their horizontal faces.

The seat (130) is a square piece of polypropylene 18 inches by 18 inches and 1 inch thick. It attaches to the frame (132) via 0.5 inch long, ¼-20 steel screws (not shown), screwed through the seat attachment holes (not shown—see 1260,1446 in FIGS. 12 and 14) in the frame (132) and into the base of the seat (130). The upward curving lip (150) along the back edge of the rear crossbar of the frame (136) abuts the rear of the seat (130) when assembled.

The front leg (152) is a 'U' of 1 inch by 1 inch aluminum. The 2 sides (154) of the 'U' are 23 inches long and the base side (156) of the 'U' is 17.75 inches long. Each side (154) of the 'U' has two 0.25 inch diameter pin attachment holes (158,160) made horizontally through its sides, an upper pin attachment hole (158) located at 0.5 inches from its upper end (168) and a lower pin attachment hole (160) located at 10.375 inches from its upper end (168). The rear leg (162) is also a 'U' of 1 inch by 1 inch aluminum. The 2 sides (190) of the 'U' are 24.625 inches long and the base side (164) of the 'U' is 15.5 inches long. Each side (190) of the 'U' has two 0.25 inch diameter pin attachment holes (158,160) made horizontally through its sides, an upper pin attachment hole (158) located at 0.5 inches from its upper end (184) and a lower pin attachment hole (160) located at 11.25 inches from its upper end (184).

0.25 inch diameter pins with 0.5 inch diameter heads (166,180, 182) are used to attach the legs (152, 162) to the frame (132) and to each other. The upper ends (168) of the front leg (152) slidably attach to the front leg pin slots (144) on the frame via 1.125 inch long front leg frame attachment pins (180). The upper ends (184) of the rear leg (162) attach to the leg attachment protrusions (142) of the front crossbar (134) of the frame via 1.25 inch long rear leg frame attachment pins (182). The front (152) and rear (162) legs thus crisscross each other, with the rear leg (162) positioned inside the front leg (152). Where they cross, the front (152) and rear (162) legs are connected to one another through the lower pin attachment holes (160) via 2.13 inch long leg-to-leg attachment pins (166).

Figure 4:
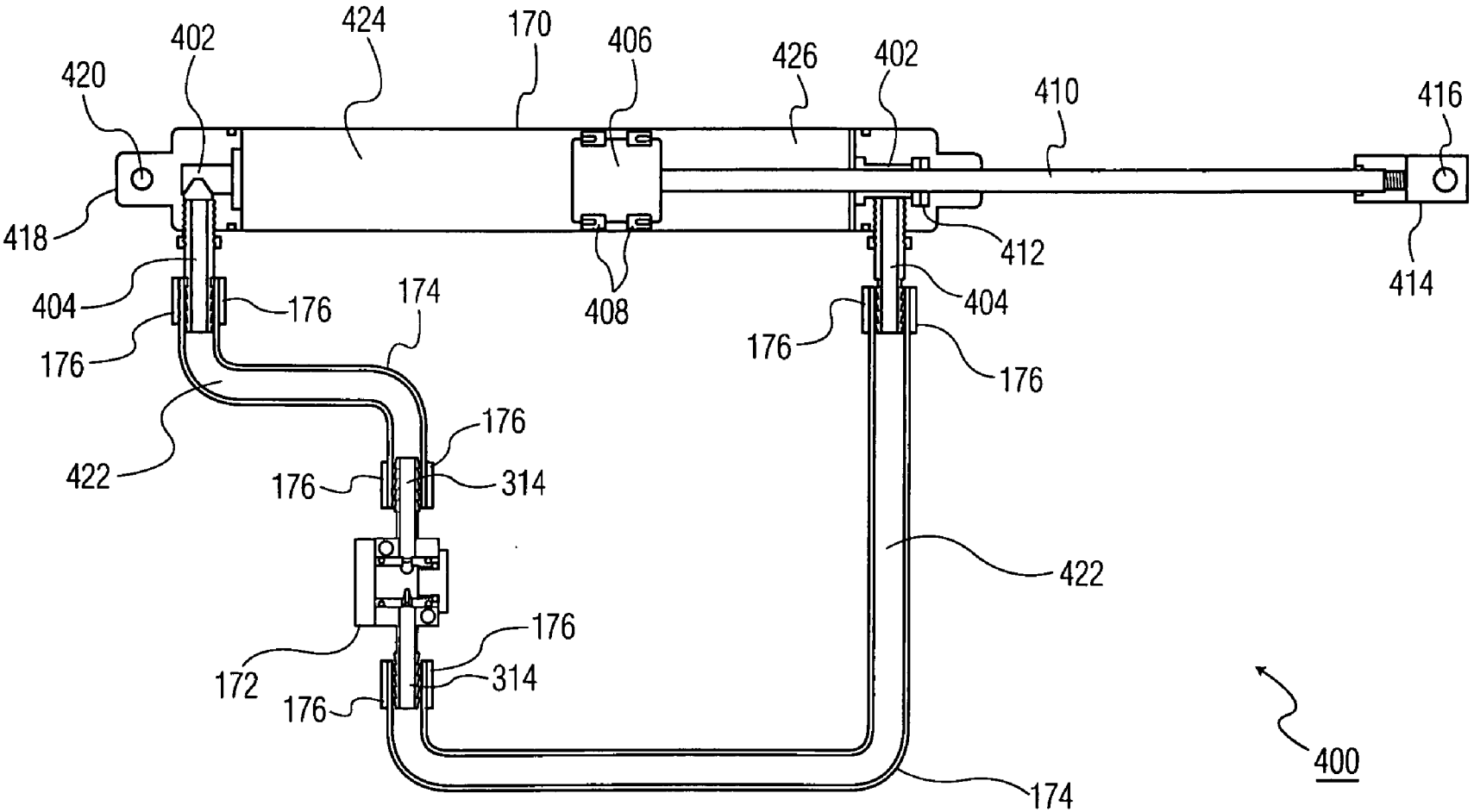
FIG. 4 shows an example of a resistance mechanism and resistance adjustment valve for a piston in cylinder resistance embodiment of the collapsible rotary torso exercise machine.

The resistance mechanism for this embodiment is piston in cylinder resistance. Referring to FIG. 4, there is shown a cross-sectional view of the piston in cylinder resistance mechanism of an example of a piston in cylinder resistance embodiment of a collapsible portable rotary torso exercise machine. The cylinder (170) is essentially a closed aluminum tube, 7.231 inches long, with inside diameter of 1.0625 inches and outer diameter of 1.125 inches. The cylinder has aluminum cylinder endcaps (402) 1.125 inches in diameter which are contiguous with the cylinder (170) at either end. The cylinder endcaps (402) each connect to a 1.476 inch long ¼ inch NPT brass hose barb (404) made to fit 0.25 inch inner diameter tubing.

The cylinder (170) has an aluminum piston (406) within it which has a 1.0625 inch diameter at its widest point and is 1 inch thick. Two nitrile rubber piston seals (408), each 1.0625 inch outer diameter, 0.75 inch inner diameter and 0.25 inches wide, are disposed upon the piston (406) around its circumference. A 0.25 inch diameter, 8.234 inch long piston rod (410) penetrates the rear cylinder endcap (402) and then enters the rear end of the cylinder (170) and attaches to the piston (406). A nitrile rubber piston rod seal (412), 0.4 inches outer diameter, 0.25 inches inner diameter and 0.15 inches wide, seals the piston rod (410) where it passes through the cylinder endcap (402).

The rear end of the piston rod (410) attaches via threads to a steel clevis (414), 0.5 inches by 0.5 inches by 1.25 inches in length. The clevis (414) has a 0.25 inch diameter rotational member attachment hole (416) through its center and attaches to the rotational member (122) via a 0.75 inch long, 0.25 inch diameter brass rotational member attachment pin (186) with 0.5 inch head.

The front end of the cylinder has a frame attachment protrusion (418) with a 0.25 inch diameter frame attachment hole (420). The front of the cylinder attaches through the frame attachment hole (420) to the cylinder attachment hole (140) in the front crossbar (134) via a 1.1 inch long, 0.25 inch diameter brass front crossbar attachment pin (188) with 0.5 inch diameter head.

Referring back to FIG. 3, the resistance adjustment valve (172) comprises a valve body (304), a valve core (306), a valve plug (308), 2 valve core O-rings (310), and a valve plug O-ring (312). The valve body (304) is on the outside a rectangular brass block 0.75 inches by 0.75 inches by 1 inch long with 2 hose barbs (314) to fit 0.25 inch inner diameter tubing, one protruding from each end of the valve body (304). The valve body (304) has two 0.170 inch diameter frame attachment holes (316) located at opposite corners of the block. A 0.575 inch diameter cylindrical bore (318) passes through the center of the valve body (304) perpendicular to the hose barbs (314). There are openings at opposite sides of the cylindrical bore (318) contiguous with the interior of the hose barbs (314).

The valve core (306) is essentially a 0.573 inch outer diameter, 0.370 inch inner diameter brass cylinder having at one end a 1 inch diameter, 0.250 inch thick integral cap which is the resistance adjustment knob (322). There are 2 teardrop shaped holes (324) penetrating the cylinder perpendicular to the cylinder surface at opposite sides of the cylinder at the middle of its length. These teardrop shaped holes (324) align with the interior of the valve body hose barbs (314) when the resistance adjustment valve (172) is assembled. The end of the cylinder opposing the resistance adjustment knob is internally threaded and has a counterbore at the internal tip to accommodate the valve plug O-ring (312). Externally the cylinder has two 0.075 inch wide grooves (326) around the circumference to accommodate the valve core O-rings (310).

The valve plug (308) is a brass 0.630 inch hexagonal head screw-on cap. The valve core (306) and valve plug (308) are inserted into opposite ends of the interior cylindrical bore (318) of the valve body (304) and then screw together via threads. Two valve core O-rings (310), each 0.575 inches outer diameter, 0.425 inches inner diameter, 0.075 inches thick, are disposed upon the valve core (306) and a valve plug O-ring (312), 0.45 inches outer diameter, 0.30 inches inner diameter, and 0.075 inches thick, is disposed upon the valve plug (308) to seal the resistance adjustment valve assembly (172) from leakage. (Note: all O-ring dimensions given are 'when assembled.')

The assembled resistance adjustment valve (172) is attached to the front crossbar (134) of the frame (132) through the frame attachment holes (316) into the resistance adjustment valve attachment holes (302) via 2 #8-32, 0.875 inch long brass screws (320).

Two lengths of 0.25 inch inner diameter high pressure hydraulic hose (174) attach the resistance adjustment valve (172) to the cylinder (170). One length of hose (174) attaches the hose barb (314) on one side of the resistance adjustment valve (172) to the hose barb (404) at the rear of the cylinder while the other length of hose (174) attaches the other resistance adjustment valve hose barb (314) to the hose barb (404) at the front of the cylinder, thus forming a closed fluid circuit between the cylinder (170) and the resistance adjustment valve (172). Any suitable pressure resistant hoses that can safely withstand the typical maximum generated pressure, which is estimated to be on the order of 200-300 psi, and which can suitably flex to accommodate the relatively small movement of the cylinder (170) during the use of the machine, can be successfully utilized in constructing embodiments of the present invention.

The hoses (174) are securely fastened to the hose barbs (314,404) using standard hose clamps (176) in this example. However, the present invention is not meant to be limited to the use of standard hose clamps as any other suitable hose to barb fastener, such as ferrules for example, may be successfully utilized.

In the present example, the cylinder (170), hoses (174) and valve (172) are filled with mineral oil as hydraulic fluid (422). However the use of mineral oil in the present example is not meant to the limit the invention to the use of this specific fluid. Any suitable hydraulic liquid, such as e.g. silicone oil or even water, can be successfully utilized to create a hydraulic piston in cylinder resistance mechanism. Or any suitable gas may be utilized thereby creating a pneumatic piston in cylinder resistance mechanism. When gas is utilized to fill the resistance mechanism (i.e. pneumatic embodiments), the O-rings and seals would typically be lubricated.

The measurements, material and design given above for a piston in cylinder resistance embodiment of the collapsible rotary torso exercise machine are typical. The invention is not to meant to be limited to these specific measurements, materials, or design as the invention may be made with numerous design variations in any desired size and of any suitable materials.

Operation

Figure 5:
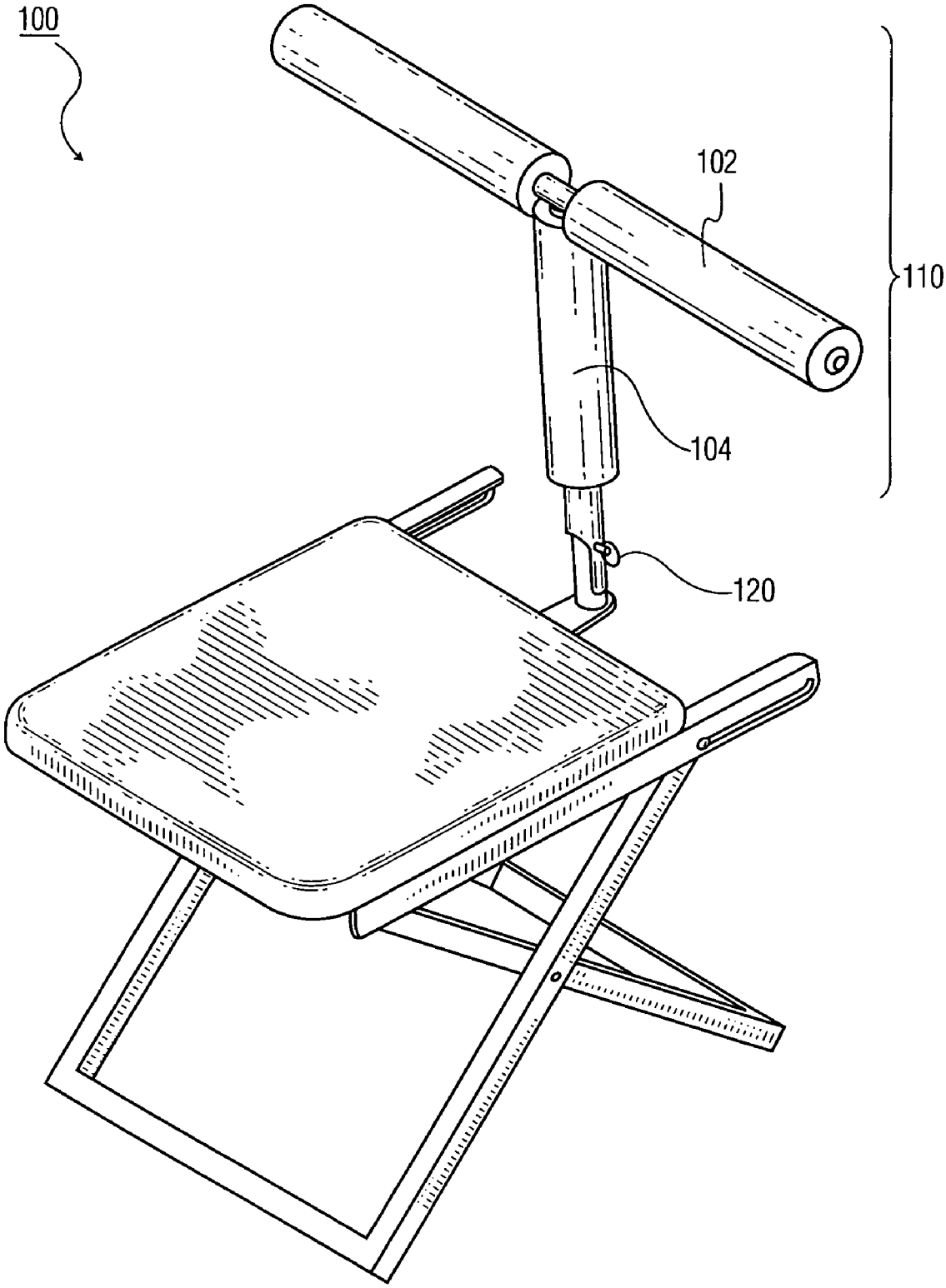
FIG. 5 shows a top oblique view of an example of an assembled piston in cylinder resistance embodiment of the collapsible rotary torso exercise machine.

Referring to FIG. 5, there is shown a top oblique view of an example of an assembled embodiment of a collapsible rotary torso exercise machine with piston in cylinder resistance ready for exercise use.

Figure 6:
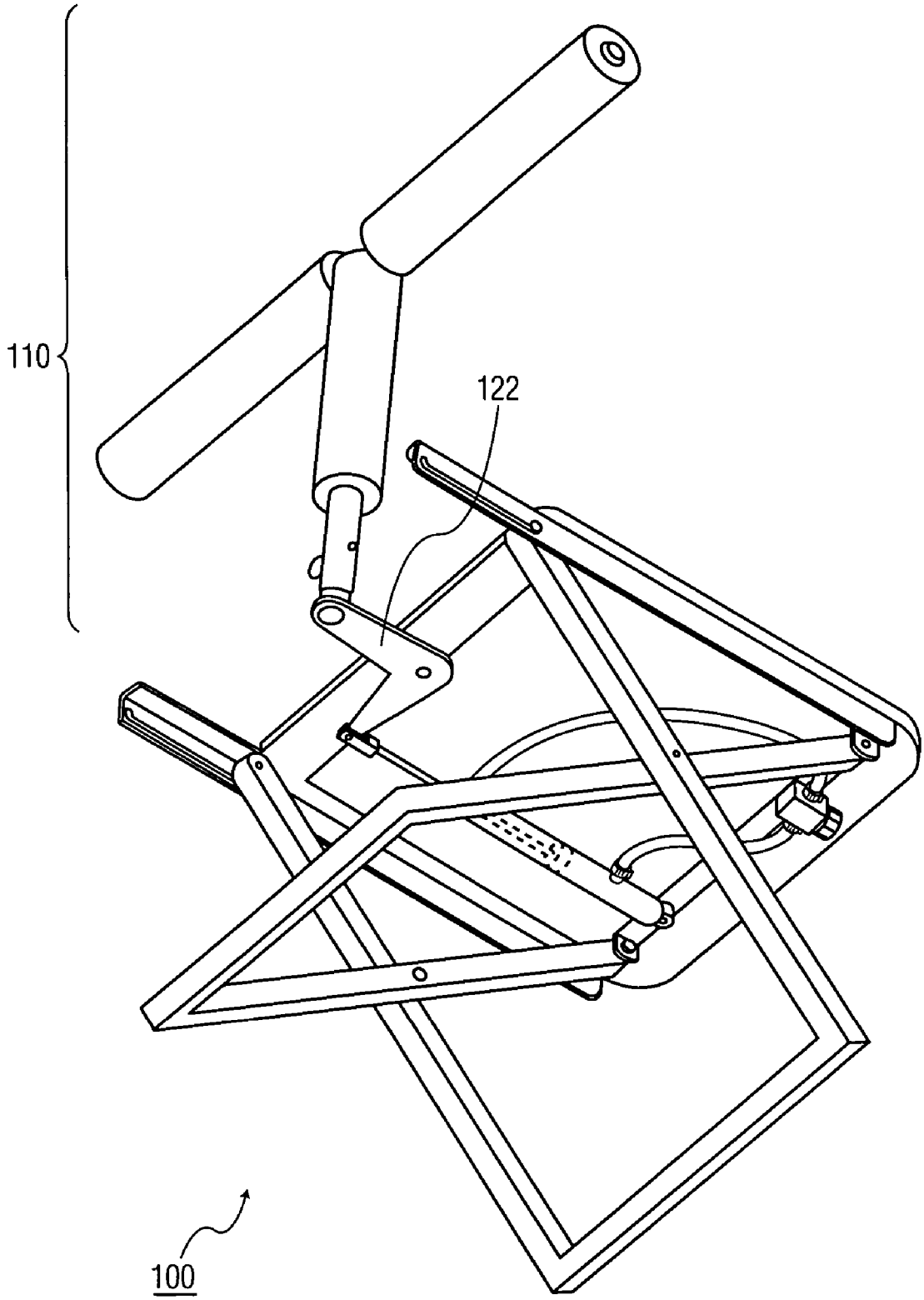
FIG. 6 shows a bottom oblique view of an example of an assembled piston in cylinder resistance embodiment of the collapsible rotary torso exercise machine.

Referring to FIG. 6, there is shown a bottom oblique view of an example of an assembled embodiment of a collapsible rotary torso exercise machine with piston in cylinder resistance ready for exercise use.

Figure 7:
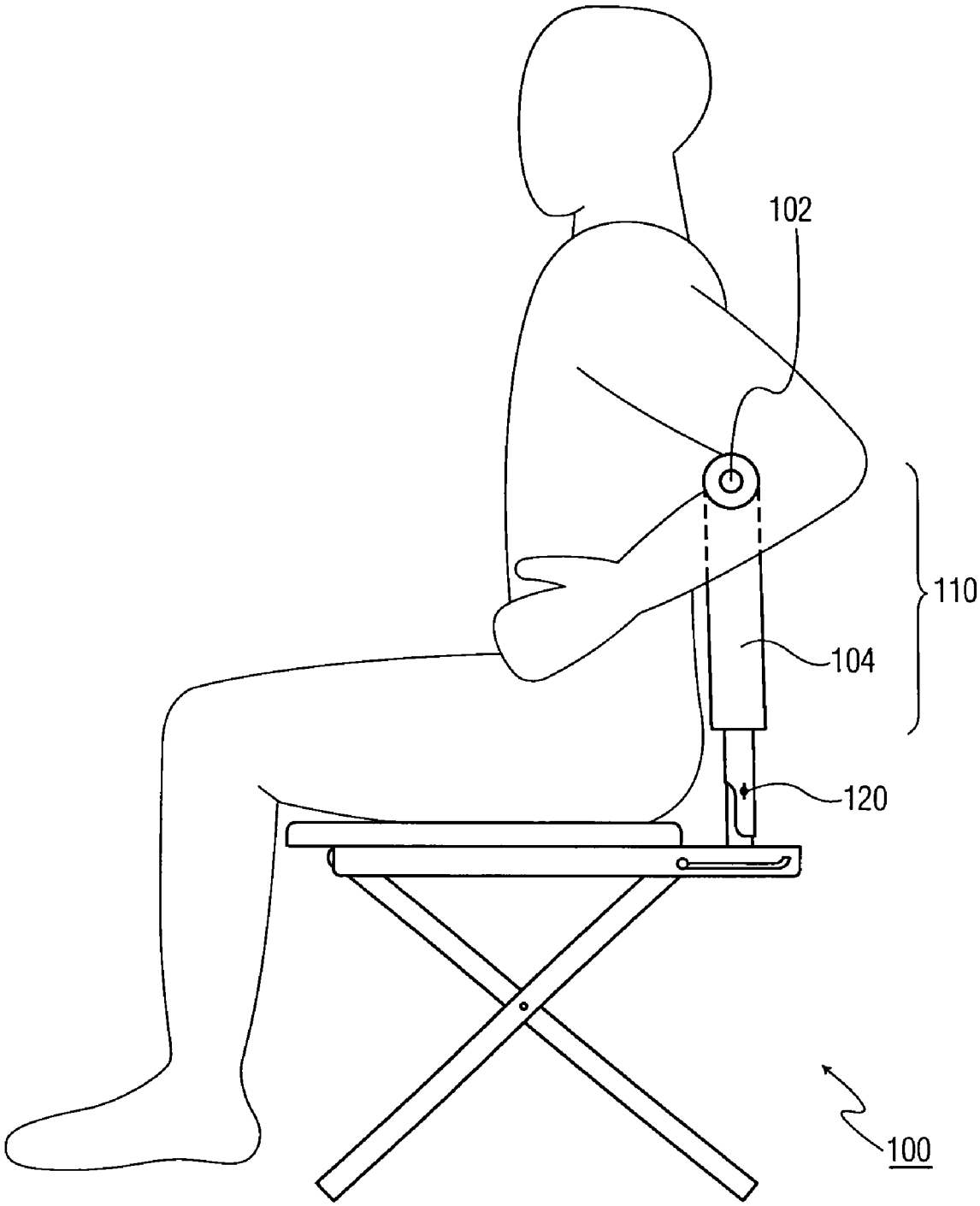
FIG. 7 shows a side view of a user on an example of an assembled piston in cylinder resistance embodiment of the collapsible rotary torso exercise machine.

Referring to FIG. 7, there is shown a side view of an example of an assembled piston in cylinder resistance embodiment of a collapsible rotary torso exercise machine with a user in exercise position upon the machine.

Figure 8:
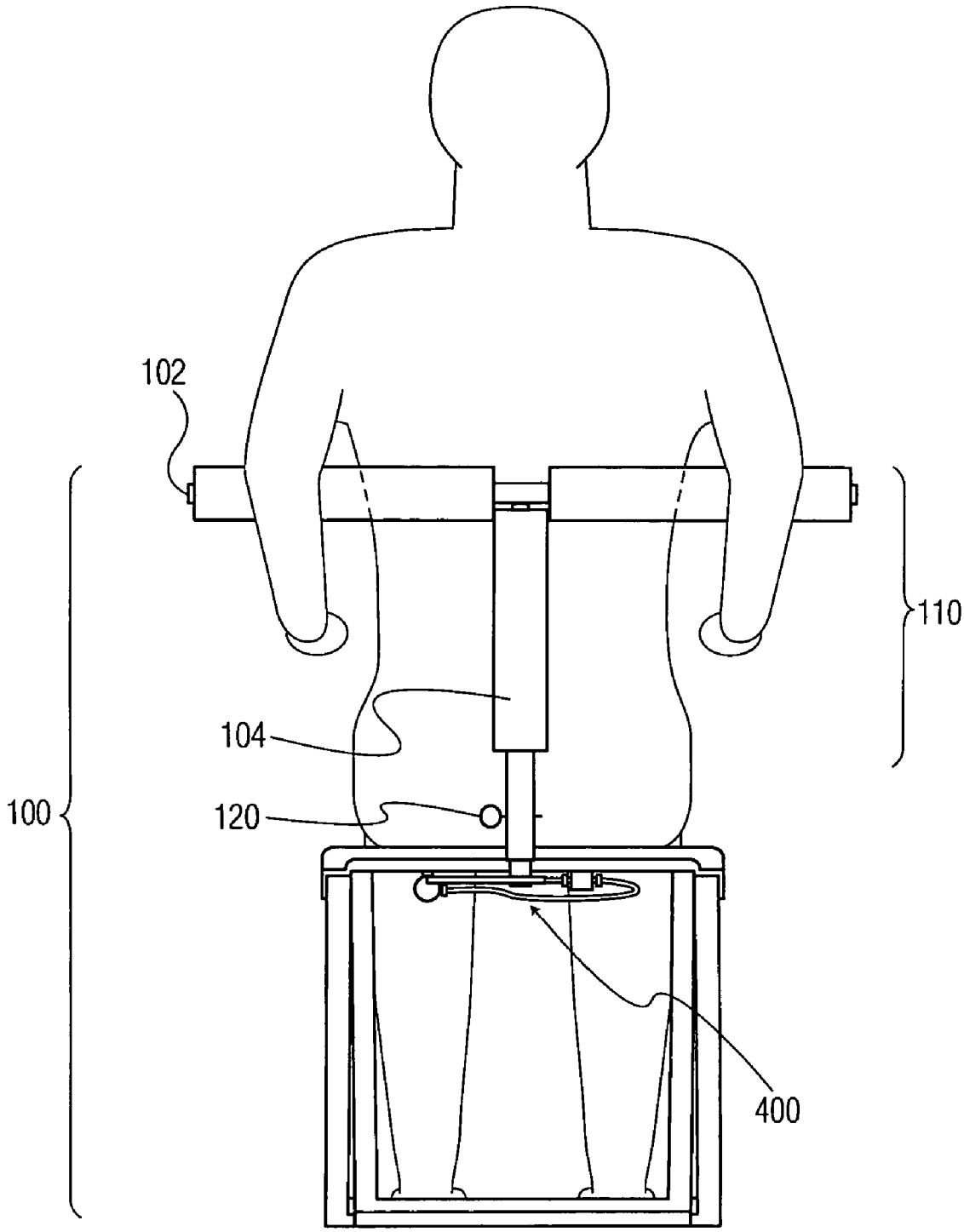
FIG. 8 shows a rear view of a user on an example of an assembled piston in cylinder resistance embodiment of the collapsible rotary torso exercise machine.

Referring to FIG. 8, there is shown a rear view of an example of an assembled embodiment of a collapsible rotary torso exercise machine with piston in cylinder resistance with a user in exercise position upon the machine.

To operate the piston in cylinder resistance embodiment of the collapsible rotary torso exercise machine, the user is seated on the exercise machine with back against the T-bar assembly (110) with arms hooked over the horizontal bar (102) as shown FIGS. 7 and 8. By twisting the torso from side to side while firmly grasping the horizontal bar (102) with the crooks of the elbows, the resistance mechanism (400) is engaged and positively resisted rotary torso exercise is accomplished. By twisting from side to side in a rotary motion, the T-bar assembly (110) together with the rotational member (122) are rotated in a horizontal arc around the rotation pin (178) thereby cranking the rotational member (122) and engaging the resistance mechanism (400) to resist the torso rotary motion. This arc allows the torso to twist in a natural rotary motion, rotating in a substantially horizontal plane around the axis of the spine, and providing excellent resisted exercise for the oblique muscles as well as other muscles involved in torso rotary motion.

Figures 9A, 9B, 9C:
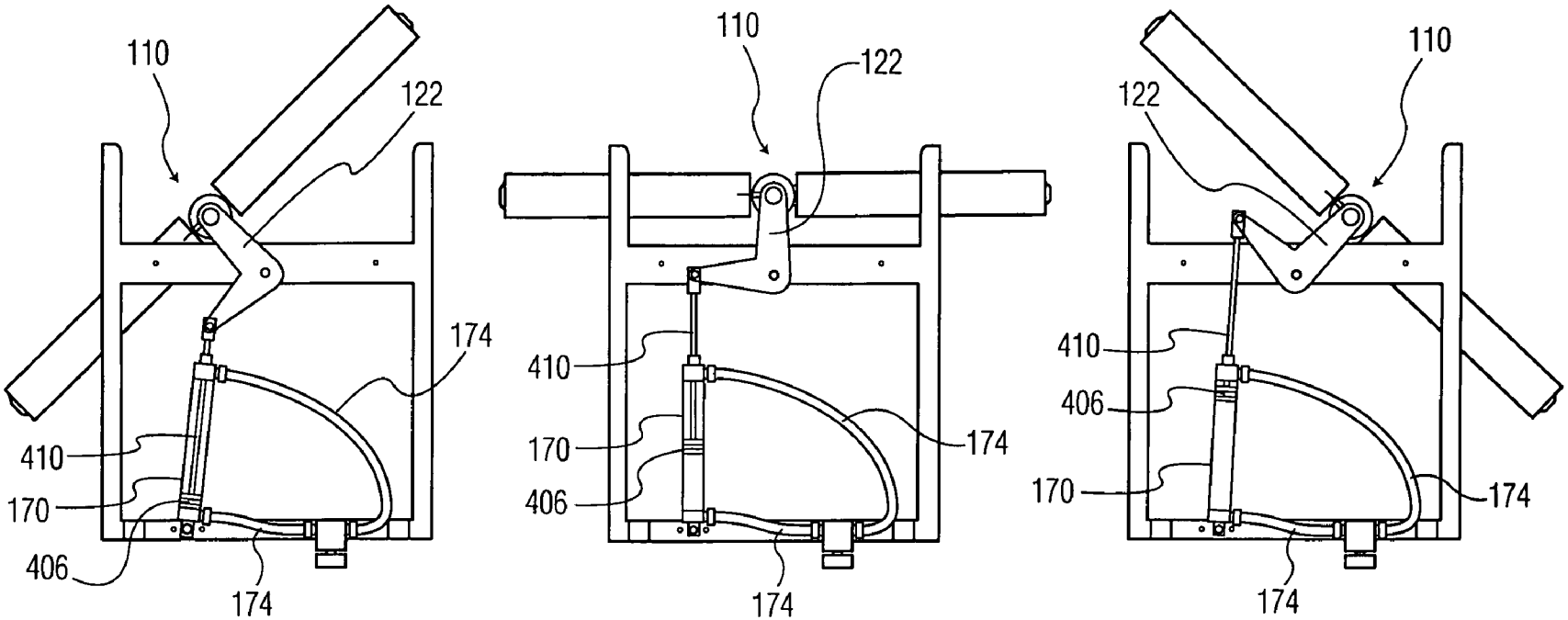
FIG. 9 shows the function/operation of the resistance mechanism of an example of a piston in cylinder resistance embodiment of the collapsible rotary torso exercise machine.

Referring to FIG. 9, there is shown a bottom view of the function/operation of the resistance mechanism (400) of an example of a piston in cylinder embodiment of the collapsible rotary torso exercise machine. Referring to FIG. 9A, as the torso together with T-bar assembly (110) is turned to the user's right, the attached rotational member (122) pushing on the piston rod (410) pushes the piston (406) into the cylinder (170). Referring to FIG. 9B, as the user together with T-bar (110) assembly turns back to the center neutral position, the piston (406) is pulled partway back through the cylinder (170) by the turning rotational member (122) pulling on the piston rod (410). Referring to FIG. 9C, as the user together with T-bar (110) assembly turns to the left of center, the piston (406) is pulled further back in the cylinder (170) by the turning rotational member (122) pulling on the piston rod (410). As the user moves back to center, the mechanism returns to the position illustrated in FIG. 9B. During these motions, the cylinder (170) and hoses (174) also pivot slightly from side to side to accommodate the angular motion of the rotational member (122) as it turns.

When the resistance mechanism is filled with liquid, the piston in cylinder resistance mechanism (400) will always offer positive resistance against the horizontal rotation of the T-bar (110)/rotational member (122) assembly no matter which direction the user is turning. Due to the incompressibility of liquid, when the user of the device stops applying rotary force to the T-bar assembly, resistant pressure will also stop immediately i.e the machine does not continue to push back against the user when the user stops attempting to turn. When the user changes direction and attempts to turn the T-bar assembly (110) in the opposite orientation, the hydraulic piston in cylinder resistance mechanism (400) will immediately give positive resistance against the new direction of attempted motion.

When the piston in cylinder resistance mechanism is filled with gas, the dynamics of the resistance mechanism function somewhat differently. Whereas liquid is virtually incompressible, gas is compressible. Thus as the pneumatic resistance mechanism is engaged by the user entering into the exercise motion, there is an initial disparity in gas pressure between the two chambers of the cylinder (424, 426) with the gas in the chamber on one side of the piston (406) and the connected hose (174) up to the resistance adjustment valve (172) temporarily rising higher as the gas pressure in the cylinder chamber on the other side of the piston (406) and connected hose (174) up to the other side of the resistance adjustment valve (172) temporarily drops. These two pressures will tend to equalize but it takes time for them to do so. This results in some differences in the resistance characteristics of the pneumatic piston in cylinder resistance mechanism as compared with the hydraulic piston in cylinder resistance mechanism.

The first difference is that using pneumatic resistance, once an exercise motion in a given orientation has been started, when the user stops motion in that direction, the resistance mechanism (400) will still positively push back against that direction of exercise somewhat until the pressures have time to equalize. As with hydraulic resistance, pneumatic resistance will tend to offer positive resistance against the direction of the turning of the T-bar assembly (110) but with the pneumatic resistance, if one stops at the end of an exercise motion and then quickly reverses direction, the unequalized pressures will momentarily push in the same direction as the new motion of the T-bar assembly (110). Another difference is that the initial feel of the resistance of the resistance mechanism (400) when one turns the T-bar assembly (110) will be 'spongier' in the pneumatic situation as some of the pressure applied to turning the T-bar assembly (110) will initially translate into changes in gas pressure and then gradually translate into movement of the piston (406) inside the cylinder (170) as the pressures move towards equalization.

The amount of resistance offered by the piston/cylinder arrangement as the piston (406) is pushed forward into the front of the cylinder (170) is nearly equal to the resistance offered as the piston (406) is pulled back to the rear of the cylinder (170) thus resulting in nearly equal resistance for a (given resistance setting) to either clockwise or counterclockwise turning of the T-bar assembly (110). There is a small difference in the resistance offered by the fluid in the chamber to the rear (426) of the piston (406) as compared to the resistance offered by the fluid in the chamber to the front (424) of the piston (406) due to displacement of fluid by the piston rod (410) and its effect on the cross-sectional area of fluid against the piston (406). So long as the diameter of the piston rod (410) is small relative to the inner diameter of the cylinder (170), the discrepancy is minimal. In the current example, the discrepancy between resistance offered to the two orientations of movement for a given resistance setting is on the order of 5%.

The amount of resistance offered by the piston in cylinder resistance mechanism (400) may be adjusted by turning the resistance adjustment knob (322) on the resistance adjustment valve (172). As the resistance adjustment knob (322) is turned, the alignment of the teardrop shaped holes (324) relative to the interior conduits of the valve hose barbs (314) changes thus reducing or increasing the fluid flow through the valve (172). The resistance adjustment valve (172) in its fully open position will permit the maximum fluid flow through the hoses (174) from the cylinder chamber to the rear (426) of the piston to the cylinder chamber in front (424) of the piston (406) and vice versa. This equates to the minimum resistance setting. When the valve is fully closed, it blocks the flow of fluid (422) through the resistance adjustment valve (172) completely. This equates to the maximum resistance setting. Any resistance setting between minimum and maximum desired may be attained by turning the resistance adjustment knob (322) to the appropriate position.

Due to the incompressibility of liquids, when the resistance mechanism is filled with liquid, the fully closed valve (172) will effectively stop the exercise motion completely. However, due to the compressibility of gases, when the resistance mechanism is filled with gas and the resistance adjustment valve (172) is fully closed, there will still be a certain amount of give so that the T-bar assembly (110) can be rotated somewhat but will be more and more difficult to turn, the further one moves it and once pressure upon the T-bar assembly (110) is released, it will turn back to the position at which the valve (172) was closed.

When exercise is complete and the user desires to store the machine, the user disembarks the machine and the upper vertical post (104), and therefore the entire T-bar assembly (110), can fold down. The front leg frame attachment pins (180) are disengaged from the leg-extended pin-locking inlets (146) and as the tops of the front leg (168) slide rearward, the front leg frame attachment pins (180) slide rearward along the front leg pin slots (144). Simultaneously, both the front (152) and rear (162) legs collapse flat against the underside of the frame (132). Rotation occurs around the rear leg frame attachment pins (182) and the leg-to-leg attachment pins (166) to allow this motion. As the weight of the machine drops down onto the collapsed legs, the front leg frame attachment pins (180) will engage the legs-collapsed pin-locking inlets (148) and the machine will fold into its fully collapsed position. In its fully folded position, this example of the rotary torso exercise machine folds down to a height of less than 5 inches.

Figure 10:
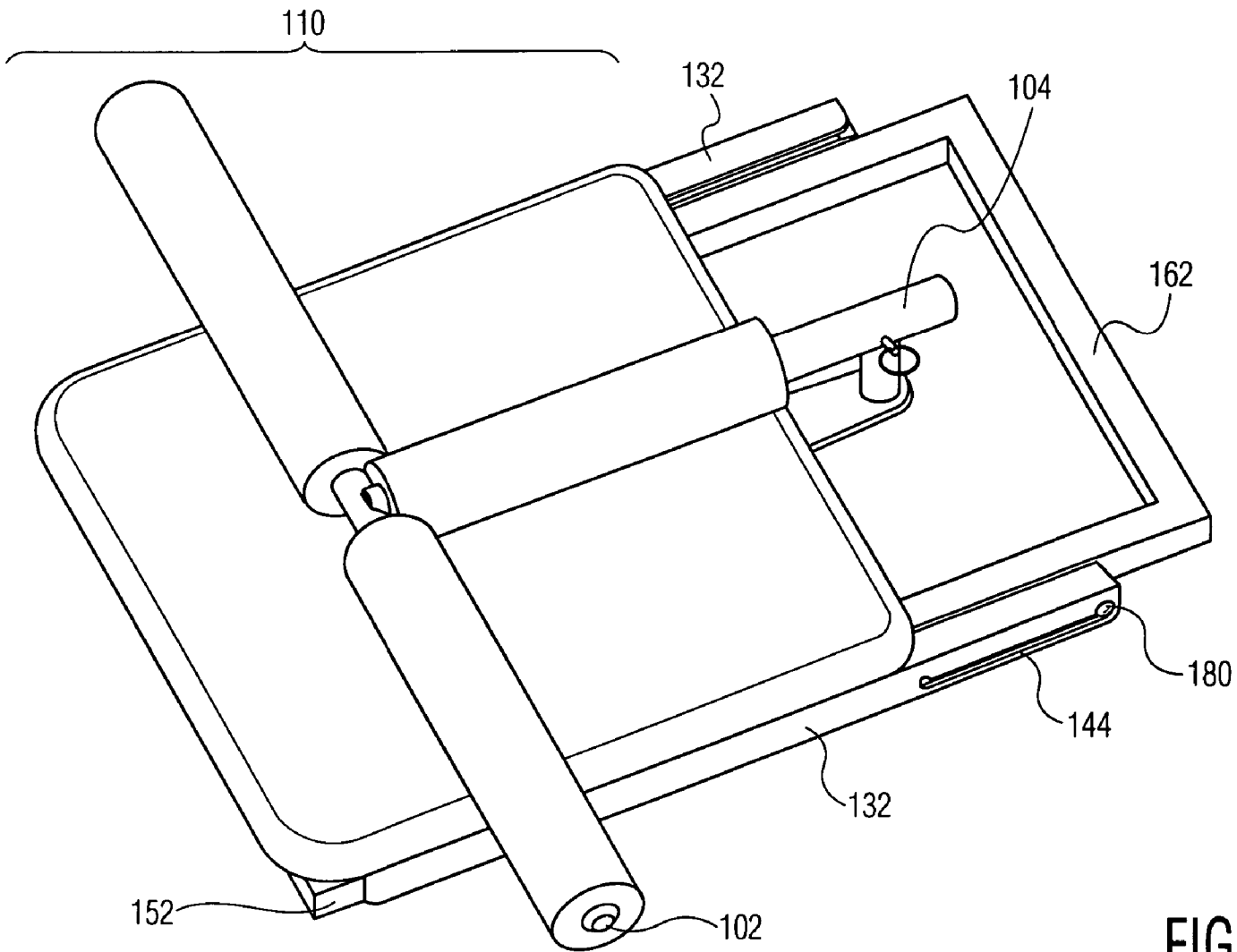
FIG. 10 shows a top view of a collapsed example of a piston in cylinder resistance embodiment of the collapsible rotary torso exercise machine.

Referring to FIG. 10, there is shown a top view of a collapsed assembled embodiment of a collapsible rotary torso exercise machine with piston in cylinder resistance. The machine can be seen in its collapsed compact storage positioning. To extend the machine for use, the T-bar assembly (110) is folded up into its upright position. The legs are opened and the front leg frame attachment pins (180) slide forward along the front leg pin slots (144) until the front leg frame attachment pins (180) lock into the leg-extended pin-locking inlets (146). The machine is then ready for use (as shown in FIG. 5).

Alternatively, for shipping purposes or as desired the T-bar assembly (110) may be detached rather than folded down by pulling the vertical post release pin (120) out of the vertical post attachment holes (108,118). The T-bar assembly (110) may then be separated from the rest of the machine. When fully folded with T-bar assembly removed, this example of the collapsible rotary torso exercise machine folds down to an overall height of less than 4.25 inches. (When the machine is folded down with T-bar assembly (110) removed, only the lower vertical post (116) actually protrudes upward to a height of nearly 4.25 inches. The remainder of the machine (100) actually folds down to a height of 2.375 inches.)

To reengage the T-bar assembly (110), the upper vertical post attachment holes (118) of the lower vertical post (116) are aligned with the lower vertical post attachment holes (108) of the upper vertical post (104) and the vertical post release pin (120) is then reengaged, thereby reattaching the T-bar assembly (110) to the rest of the machine.

Friction Resistance Embodiment

Figure 11:
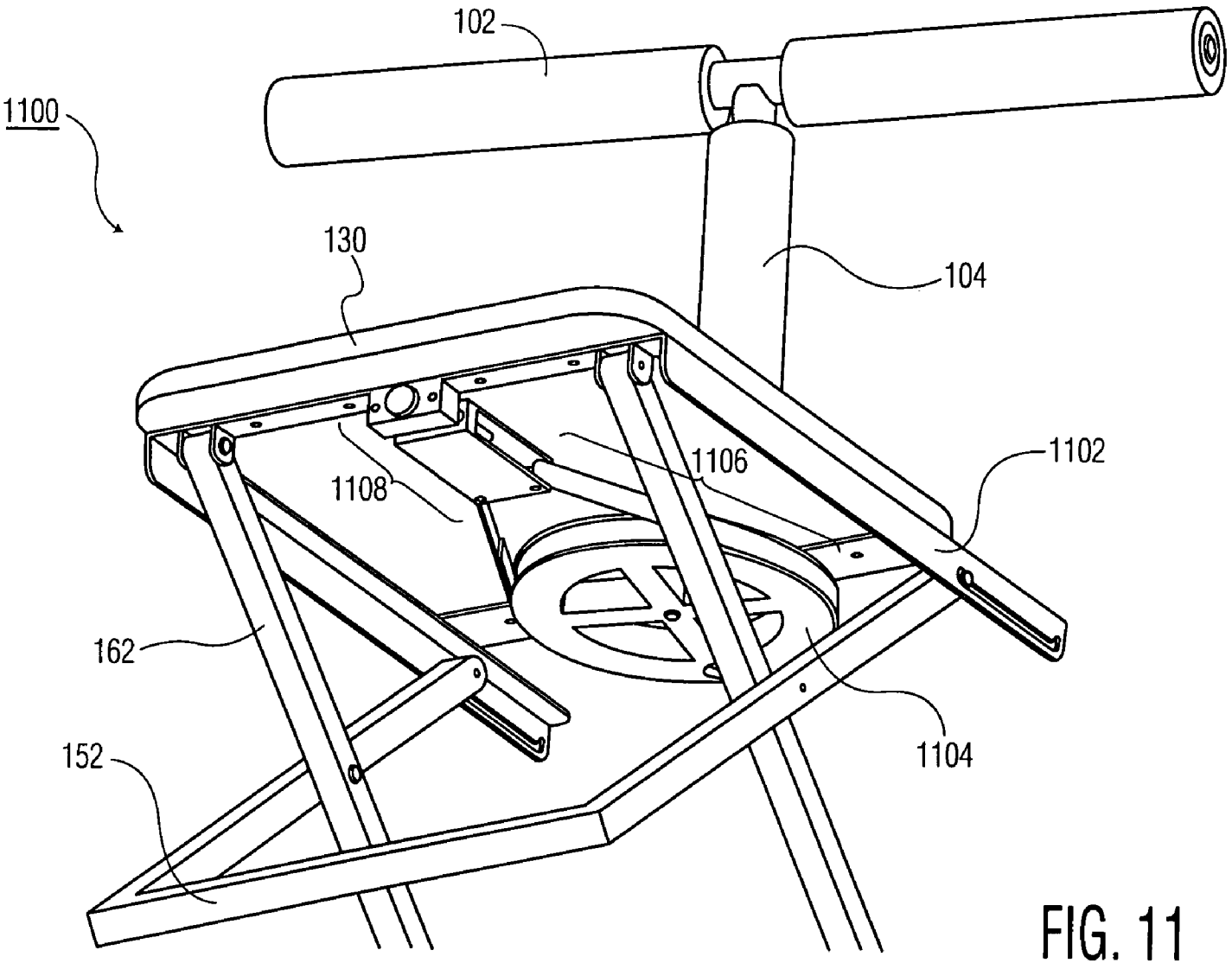
FIG. 11 shows a bottom oblique view of an example of an assembled friction resistance embodiment of the collapsible rotary torso exercise machine.

Referring to FIG. 11, there is shown an example of an assembled friction resistance embodiment (1100) of the collapsible rotary torso exercise machine. The friction resistance embodiment (1100) of the collapsible rotary torso exercise machine utilizes the same horizontal bar (102), vertical post (104), legs (152, 162), seat (130) and essentially the same frame (1102) structure as the piston in cylinder resistance embodiment (100) above. Beyond a few differences in the attachment points on the frame (1102), the differences between these two embodiments (100, 1100) lie only in the structure of the rotational member (1104), the resistance mechanism (1106) and the resistance adjustment mechanism (1108). This example uses a band brake mechanism (1106) for friction resistance.

Figure 12:
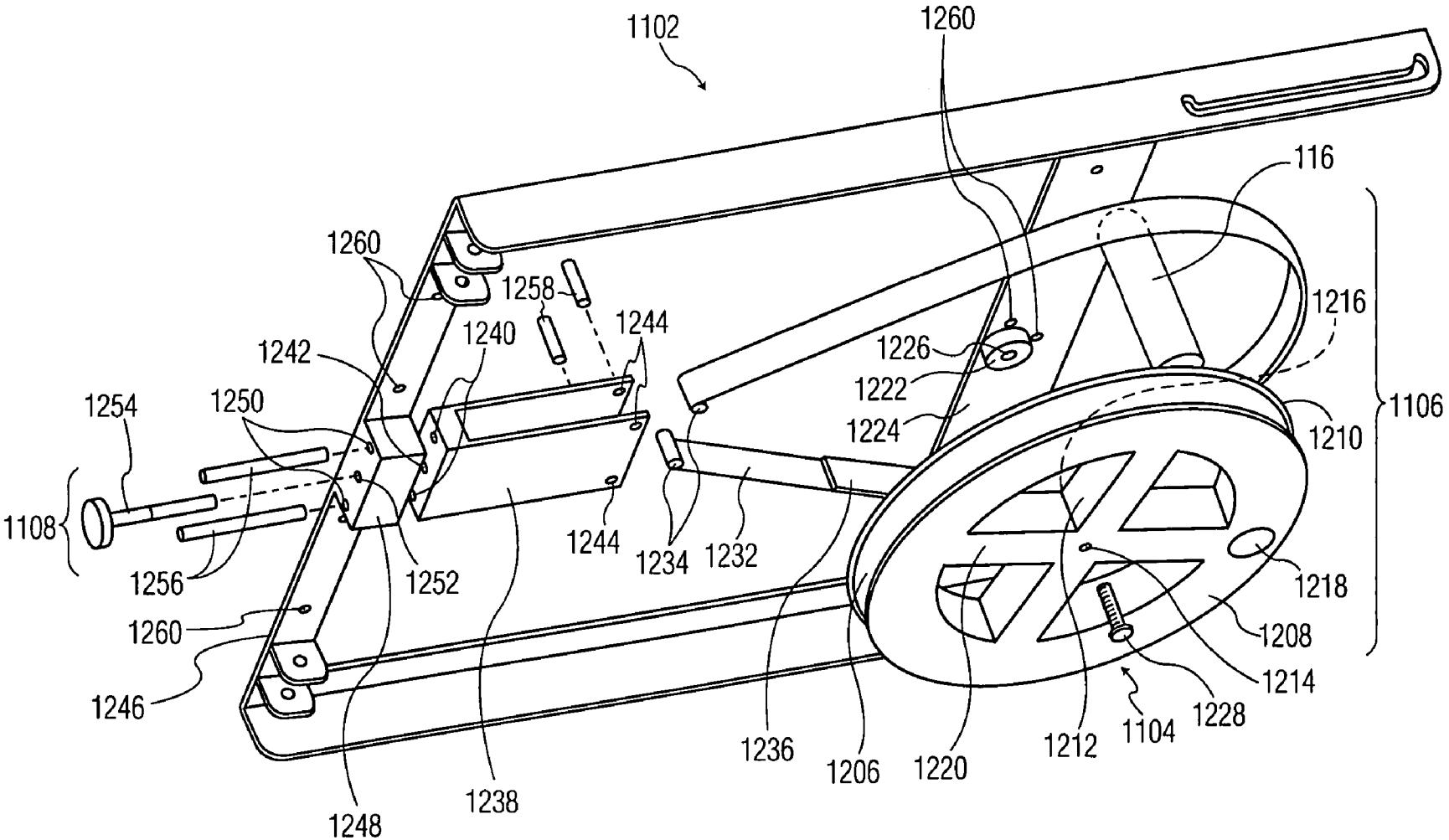
FIG. 12 shows an exploded view of the frame, rotational member and resistance mechanism of an example of a friction resistance embodiment of the collapsible rotary torso exercise machine.

Referring to FIG. 12, there is shown an exploded view of the frame (1102), rotational member (1104), resistance mechanism (1106) and resistance adjustment mechanism (1108) of a friction resistance (band brake) embodiment (1100) of the collapsible rotary torso exercise machine. In this friction resistance embodiment (1100) of the collapsible rotary torso exercise machine, the rotational member (1104) is drum- or reel-shaped. The entire rotational member is one piece cast of aluminum. The cylindrical portion (1206) of the drum-shaped rotational member (1104) is 1 inch thick aluminum formed into a cylinder 9.3 inches in diameter and 0.75 inches tall. The flanges (1208,1210) of the drum-shaped rotational member (1104) are 0.125 inch thick and 9.5 inches in diameter. There are four 90 degree wedge shaped cutouts (1212) penetrating through the circular faces of the rotational member (1104) and through the length of the cylinder (1206). The interior (1212) of the rotational member (1104) thus has four 1 inch thick spokes (1220) of solid aluminum in the shape of a cross.

The drum-shaped rotational member (1104) has a frame attachment hole (1214) which passes vertically through the center of the lower flange (1208) and 0.712 inches through the center of the interior solid cross of aluminum. A 1 inch diameter boss hole (1216) penetrates vertically into the center of the top flange (1210) and 0.288 inches into the center of the interior solid cross of aluminum. A 1 inch diameter lower vertical post attachment hole (1218) passes through the flanges (1208, 1210) and solid aluminum cross of the rotational member (1104) 0.75 inches from the circumference of the flanges (1208,1210) aligned with the center of one of the 4 spokes (1220) of the rotational member (1104).

In this friction resistance embodiment (1100), there is a 1 inch diameter, 0.288 inch thick boss (1222) located on the underside of the rear crossbar (1224) of the frame (1102) at the middle of its length centered at 0.5 inches from the front edge of the rear crossbar (1224). The boss (1222) has a 0.25 inch diameter rotational member attachment hole (1226) vertically through its center. The rotational member (1104) is attached to the frame (1102) at the rotational member attachment hole (1226) via a 0.25 inch diameter brass rotation pin (1228) with a 0.5 inch diameter head. The drum-shaped rotational member (1104) rotates around this rotation pin (1228).

The lower vertical post (116) is a 3.5 inch long, 1 inch diameter rod of solid aluminum as in the previous embodiment. The lower vertical post (116) attaches to the rotational member (1104) perpendicular to the flanges (1208,1210) of the drum-shaped rotational member (1104) via the lower vertical post attachment hole (1218) and is welded in place.

The friction resistance band (1232) is a 0.05 inch thick, 0.75 inch wide and 34.372 inch long steel band with a band pin attachment (1234) at each end. The band pin attachment (1234) is formed by the material of the band looping back on itself and being welded to itself to form a small loop. A felt friction lining (1236), 0.1 inches thick, 0.75 inches wide and 25 inches long is bonded to the interior of the friction resistance band (1232) and centered along its length.

The friction resistance band tension adjustment bracket (1238) is an aluminum U-shaped bracket. The base of the 'U' of the friction band tension adjustment bracket (1238) is 1 inch by 2.5 inches by 0.5 inches thick. There are two 0.25 inch diameter guide pin holes (1240) through the base of the "U" located at 0.25 inches from the ends of the base of the 'U' of the friction band tension adjustment bracket (1238). There is one ¼-28 threaded tension adjustment knob attachment hole (1242) through the base of the 'U' of the friction band tension adjustment bracket (1238). The two arms of the 'U' of the friction band tension adjustment bracket (1238) are 2.5 inches wide by 4.5 inches long by 0.125 inches thick. Each arm has two 0.25 inch diameter friction band attachment holes (1244) one located 0.25 inches from either edge of the bracket and 0.25 inches from the end of the bracket arm.

The front crossbar (1246) of the frame (1102) in this friction resistance embodiment (1100), rather than having the cylinder and resistance adjustment valve attachments (140,302) as in the piston in cylinder resistance embodiment frame (132), has a friction band adjustment bracket attachment protrusion (1248), 2.5 inches long, 1 inch wide and 1 inch thick located underneath the front crossbar (1246) at the middle of its length. The friction band adjustment bracket attachment protrusion (1248) has two 0.25 inch diameter guide pin holes (1250) passing through it horizontally from forward to rear located at 0.25 inches from the ends of the protrusion (1648). One 0.25 inch diameter tension adjustment knob hole (1252) passes horizontally from forward to rear through the center of the friction band adjustment bracket attachment protrusion (1248).

The tension adjustment knob (1254) is made of brass and is 2.7 inches in total length. It has a 2.450 inch long ¼-28 threaded rod and a 1 inch diameter, 0.25 inch thick head. There are 2 straight headless brass guide pins (1256), each 3 inches long and 0.25 inches in diameter. There are also two 1 inch long, 0.25 inch diameter headless brass band pins (1258).

The friction band tension adjustment bracket (1238) is adjustably attached to the front crossbar (1246) of the frame (1102) at the inside of the friction band adjustment bracket attachment protrusion (1248) via the tension adjustment knob (1254). The tension adjustment knob (1254) is inserted through the tension adjustment knob hole (1252) in the friction band adjustment bracket attachment protrusion (1248) and into the tension adjustment knob attachment hole (1242) in the friction band tension adjustment bracket (1238). The 2 straight headless brass guide pins (1256) are inserted through the two 0.25 inch guide pin holes (1250) in the friction band adjustment bracket attachment protrusion (1248) and into the two 0.25 inch diameter guide pin holes (1240) of the friction band adjustment bracket (1238).

The friction band (1232) is wrapped around the circumference of the cylindrical surface of the rotational member (1206), felt friction surface (1236) facing the cylindrical surface of the rotational member (1206). The ends (1234) of the friction band (1232) are attached to the two 0.25 inch diameter friction band attachment holes (1244) of the friction band adjustment bracket (1238) via the two 1 inch long, 0.25 inch diameter headless brass band pins (1258).

The frame (1102) attaches to the seat (130) through seat attachment holes (1260), which are placed at intervals around the horizontal surface of the frame (1102), via 0.5 inch long ¼-20 screws.

The measurements, design, and materials for a band brake and adjustment knob given above are typical. However, the present invention is not meant to be limited to these specifications. Other designs for band brakes utilizing other suitable materials and variations on the given design may be successfully employed in creating other embodiments of the present invention. Further, other designs utilizing other types of friction resistance mechanisms can also be used to construct other embodiments of the present invention.

Operation

This example of a friction resistance (band brake) embodiment (1100) of the collapsible rotary torso exercise machine is operated in exactly the same manner as the piston in cylinder resistance embodiment (100) above with the exception that the resistance adjustment is here made via a friction resistance adjustment knob (1254) which is connected to the friction resistance band tension adjustment bracket (1238). As the knob (1254) is turned the bracket (1238) is either pulled closer to the front crossbar (1246) or released and allowed to move further away from the front crossbar (1246). This motion either tightens or loosens the tension of the friction resistance band (1232) against the surface of the drum-shaped rotational member (1104). Tightening the band (1232) creates greater resistance to horizontal rotation of the rotational member (1104) and therefore gives greater positive resistance to rotary torso exercise. Loosening the band creates less friction resistance of the friction band (1232) against the rotational member (1104) thus giving less resistance to rotary torso exercise.

The resistance characteristics of this friction resistance mechanism (1106) are similar to the hydraulic piston in cylinder resistance mechanism (400) above. This embodiment, like hydraulic versions of the piston in cylinder resistance embodiment (100) above, always provides positive resistance against the direction of rotary torso movement no matter which direction the user is turning at a given moment. When the user stops moving there is no force exerted on the T-bar assembly (110) by the resistance mechanism (1106).

Elastic Member Resistance Embodiment

Figure 13:
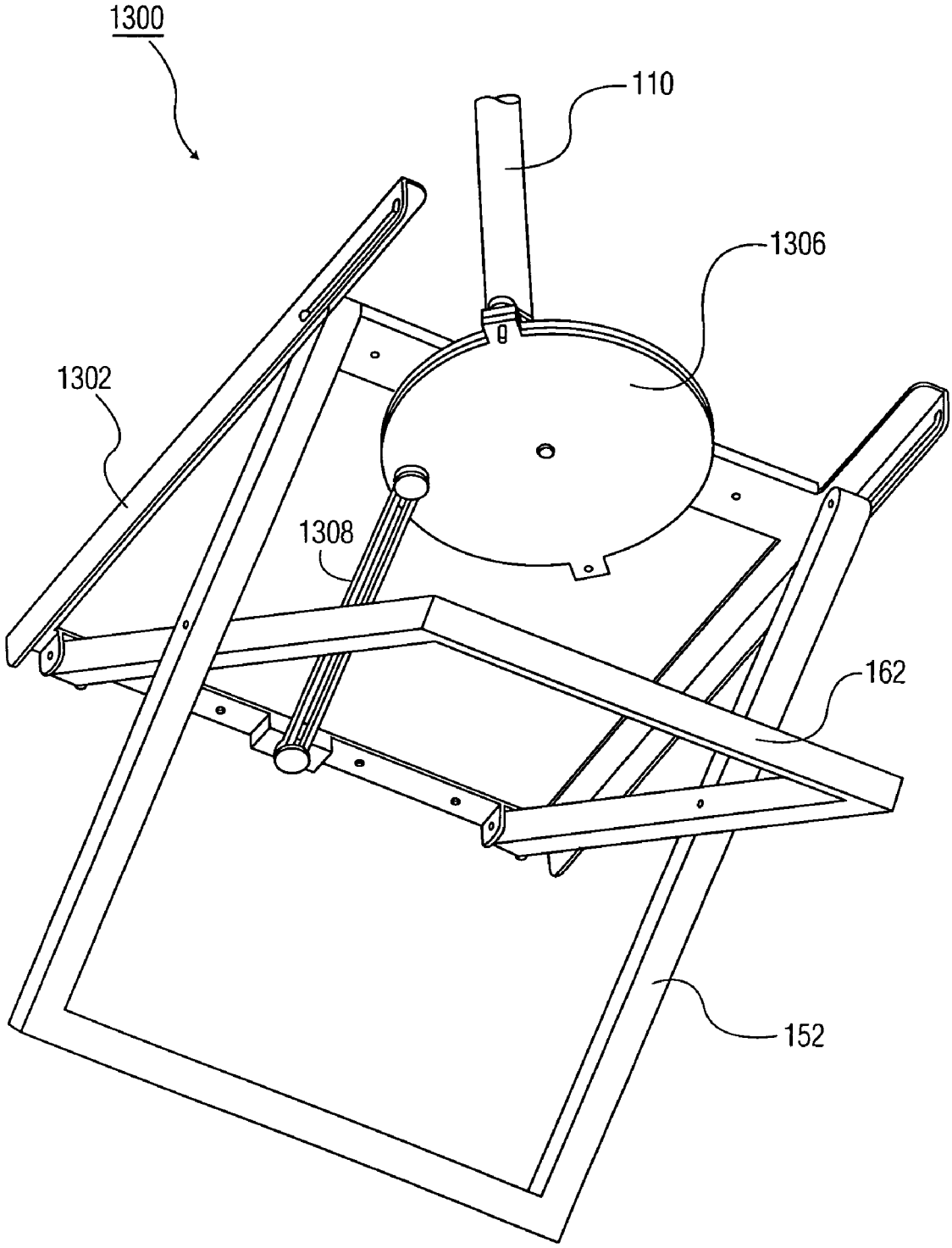
FIG. 13 shows a bottom oblique view of the legs, frame, rotational member, and resistance mechanism of an example of an assembled elastic member resistance embodiment of the collapsible rotary torso exercise machine.

Referring to FIG. 13, there is shown a partial bottom oblique view of an example of an assembled elastic member resistance embodiment (1300) of the collapsible rotary torso exercise machine. The seat (130) and upper portion of the T-bar assembly (110) are not shown.

The elastic member resistance embodiment (1300), like the friction resistance embodiment (1100) above, also utilizes the same T-bar assembly (110), legs (152,162), seat (130) and essentially the same frame (1302) structure as the piston in cylinder resistance embodiment (100). Again, beyond a few differences in the attachment points on their respective frames (1302, 132), the differences between the elastic member resistance embodiment and the piston in cylinder resistance embodiment (100) lie only in the structure of their respective rotational members (1306, 122), resistance mechanisms (1308, 400) and methods of resistance adjustment.

Figure 14:
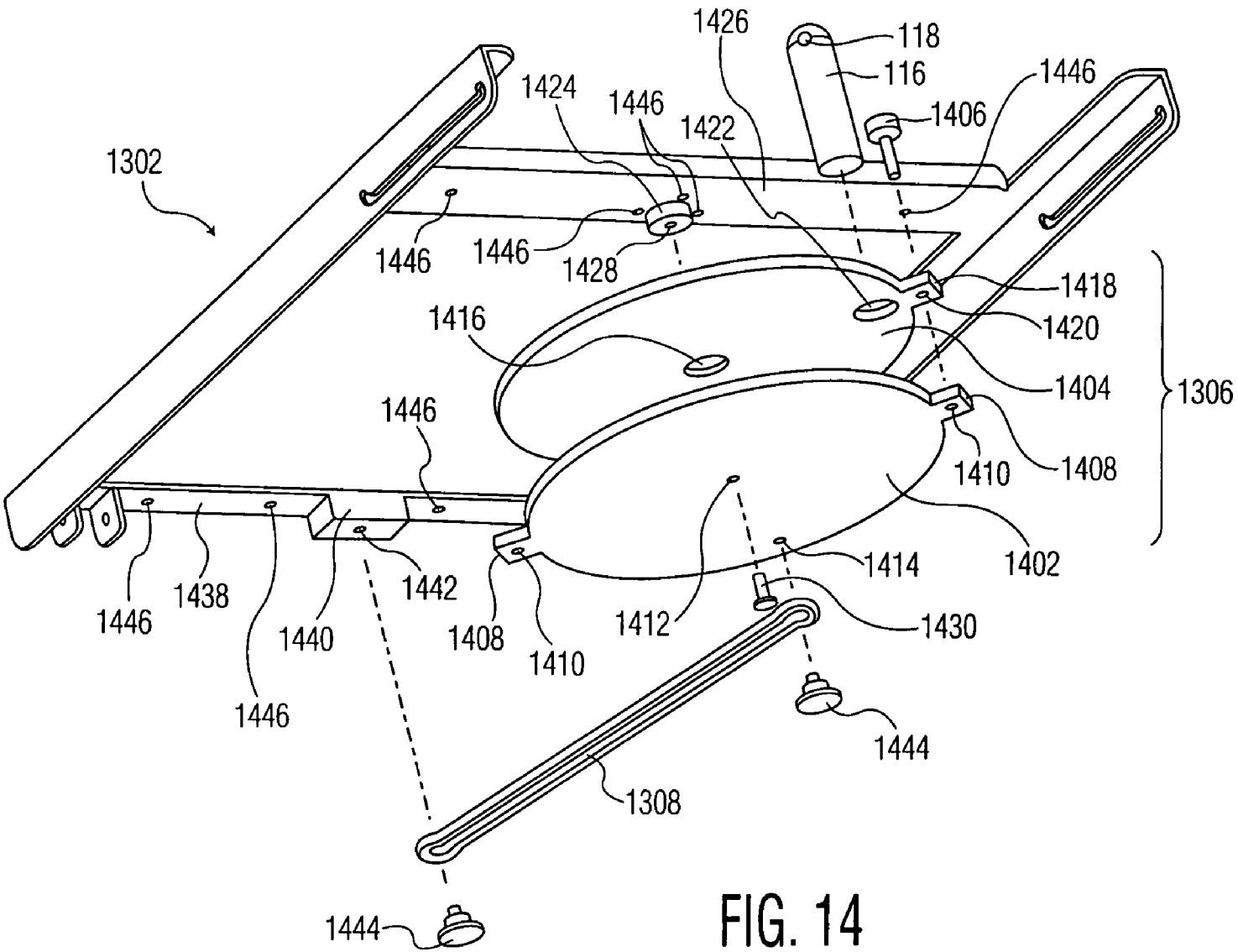
FIG. 14 shows an exploded view of the frame, rotational member, and resistance mechanism of an example of an elastic member resistance embodiment of the collapsible rotary torso exercise machine.

Referring to FIG. 14, there is shown an exploded view of the frame (1302), rotational member (1306) and resistance mechanism (1308) of an example of an elastic member resistance embodiment (1300) of the collapsible rotary torso exercise machine.

In this example of an elastic member resistance embodiment (1300) of the collapsible rotary torso exercise machine, the rotational member (1306) comprises two 9.5 inch diameter, 0.25 inch thick disc-shaped aluminum plates (1402, 1404) held in relative position to one another by a plate alignment pin (1406). The lower plate (1402) of the rotational member (1306) has two 1 inch by 0.75 inch lower plate alignment pin protrusions (1408) located 180 degrees apart from each other around the circumference of the plate (1402) extending outward from the edges of the plate (1402) in the plane of the plate (1402). Each of these lower plate alignment pin protrusions (1408) has a 0.25 inch diameter lower plate alignment pin hole (1410) vertically through its center. The lower plate (1402) has a 0.25 inch diameter frame attachment hole (1412) which passes vertically through the center of the disc-shaped plate (1402). The lower plate (1402) also has a 0.25 inch diameter elastic member pin attachment hole (1414) passing vertically through it located 90 degrees around its circumference, halfway between the two lower plate pin protrusions (1408) and 0.75 inches from the edge of the plate (1402).

The upper plate (1404) of the rotational member (1306) has a 1 inch diameter frame attachment hole (1416) which passes vertically through the center of the disc-shaped plate (1404). The upper plate (1404) has a 1 inch by 0.75 inch upper plate alignment pin protrusion (1418) extending outward from the edges of the plate (1404) in the plane of the plate (1404). This upper plate alignment pin protrusion (1418) has a 0.25 inch diameter upper plate alignment pin hole (1420) vertically through its center. A 1 inch diameter lower vertical post attachment hole (1422) passes through the upper plate (1404) 0.75 inches from the circumference of the plate (1404) aligned with the upper plate alignment pin protrusion (1418).

In this elastic member resistance embodiment (1300), there is a 1 inch diameter, 0.288 inch thick boss (1424) located on the underside of the rear crossbar (1426) at the middle of its length centered at 0.5 inches from the front edge of the rear crossbar (1426). The boss (1424) has a 0.25 inch diameter rotational member attachment hole (1428) vertically through its center. The rotational member (1306), comprising the lower (1402) and upper (1404) plates is attached to the frame (1302) at the boss (1424) via a 0.25 inch diameter brass rotation pin (1430) with a 0.5 inch diameter head. The 2-plate rotational member (1306) rotates around this rotation pin (1430).

As in previously described embodiments above, the lower vertical post (116) is a 3.5 inch tall, 1 inch diameter rod of solid aluminum with rounded top and upper vertical post attachment hole (118) made horizontally through it. The lower vertical post (116) attaches from above to the upper plate (1404) perpendicular to the plane of the plate (1404) and is welded in place in the lower vertical post attachment hole (1422).

The front crossbar (1438) of the frame (1302) in this elastic member resistance embodiment (1300), (rather than having the cylinder and resistant adjustment valve attachments (140,302) as in the piston in cylinder resistance embodiment frame (132)) has an elastic member attachment protrusion (1440), 2 inches long, 1 inch wide and 0.538 inches thick located on the underside of the front crossbar (1438) at its middle. The elastic member attachment protrusion (1440) has one 0.25 inch diameter elastic member attachment pin hole (1442) made into it 0.25 vertically from the bottom located at the center of the protrusion (1440).

In this elastic member resistance embodiment (1300) the resistance mechanism (1308) comprises one or more elastic members attached at one end to the front crossbar (1438) of the frame (1302) and at the other end to the rotational member (1306). A sample elastic member (1308) is a latex rubber band, the cross-section of the band measuring 0.25 inches wide by 0.325 inches high and the length of the band being approximately 11.5 inches.

Two 0.7 inch long aluminum elastic member attachment pins (1444) are utilized. Each elastic member attachment pin (1444) has a 3-tiered structure, the head being 1 inch in diameter and 0.125 inches thick, the middle portion of the pin being 0.5 inches in diameter and 0.325 inches long, and the tip portion being 0.25 inches in diameter and 0.25 inches long.

One end of the elastic member (1308) attaches to the front crossbar (1438) of the frame (1302) at the elastic member attachment pin hole (1842) in the elastic member attachment protrusion (1440) via an elastic member attachment pin (1444). The other end of the elastic member (1308) attaches to the lower plate (1402) at the elastic member attachment pin hole (1414) via the second elastic member attachment pin (1444).

The frame (1302) attaches to the seat (130) through seat attachment holes (1446), which are placed at intervals around the horizontal surface of the frame (1302), via 0.5 inch long ¼-20 screws.

The elastic member resistance embodiment (1300) of the collapsible rotary torso exercise machine has no resistance adjustment mechanism per se. However a means for varying the resistance is provided in that by changing the size, elasticity and or number of elastic members (1308) utilized, the resistance may be adjusted. The elastic members (1308) utilized may be rubber bands (as illustrated) or they may be springs or any other suitable elastic members. Slight modification of the elastic member attachment pins (1444), attachment holes (1442,1414), etc. may be necessary depending upon the specific type of elastic members (1308) selected.

The measurements, design, and materials for an elastic member resistance mechanism given above are typical. However, the present invention is not meant to be limited to these specifications. Other designs for elastic member resistance mechanisms utilizing other suitable materials and variations on the given design may be successfully employed in creating other embodiments of the present invention. For example alternate elastic member attachment sites may be provided on the frame as a means for varying the tension on the elastic member. Or a tension adjustment mechanism, similar to that in the friction resistance embodiment (1100) above, may be provided as a means for varying the tension on the elastic member and thus varying the resistance to the rotary torso exercise. Though a latex resistance band has been utilized for the illustration of this embodiment, any suitable elastic member may be utilized to create successful embodiments of the present invention. Springs or elastic members made of other materials may be readily substituted for the latex band described herein with no or minimal modification of the design outlined above.

Operation

The elastic member resistance embodiment (1300) is operated in the same manner as the piston in cylinder resistance (100) and friction resistance embodiments (1100) above in regard to collapsibility for storage and expansion for setup. As in the above disclosed embodiments, this example folds down to a height of less than 5 inches when the T-bar remains attached and down to a height of less than 4.25 inches when the T-bar is removed.

However the resistance mechanism (1308) and rotational member (1306) operate differently in this elastic member resistance embodiment (1300) than in the previous embodiments (100, 1100) and so the functioning of the machine during exercise is different. In this case, a user may accomplish any number of successive repetitions of 90 degrees of positively resisted exercise in only one direction at a time either from 45 degrees of clockwise torso rotation to 45 degrees of counterclockwise torso rotation or from 45 degrees of counterclockwise torso rotation to 45 degrees of clockwise torso rotation without resetting the resistance mechanism (1308) and rotational member (1306).

Figure 15C:
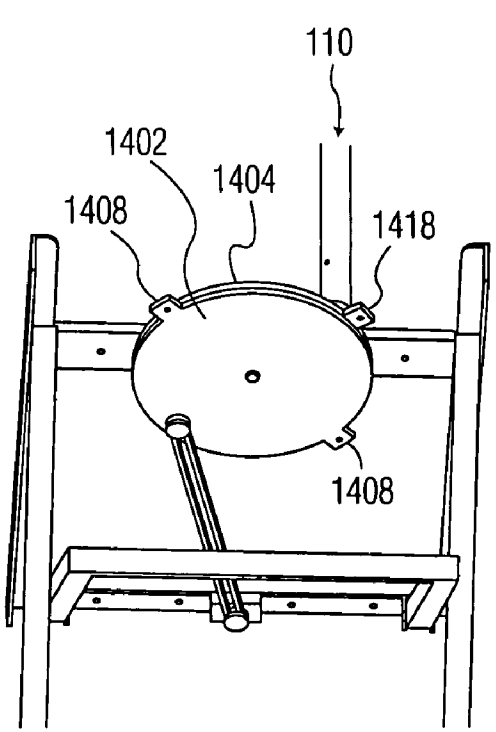
FIG. 15 shows a bottom oblique view of the resetting to the opposite orientation of the resistance mechanism of an example of an elastic member resistance embodiment of the collapsible rotary torso exercise machine.
Figure 15B:
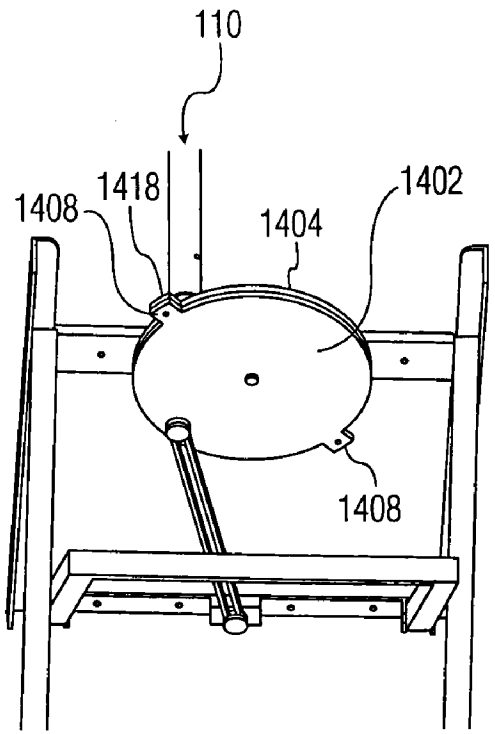
Figure 15A:
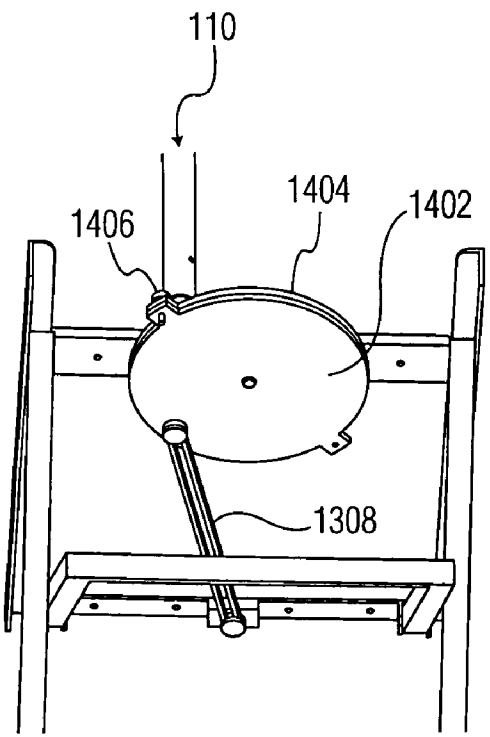
Figure 15D:
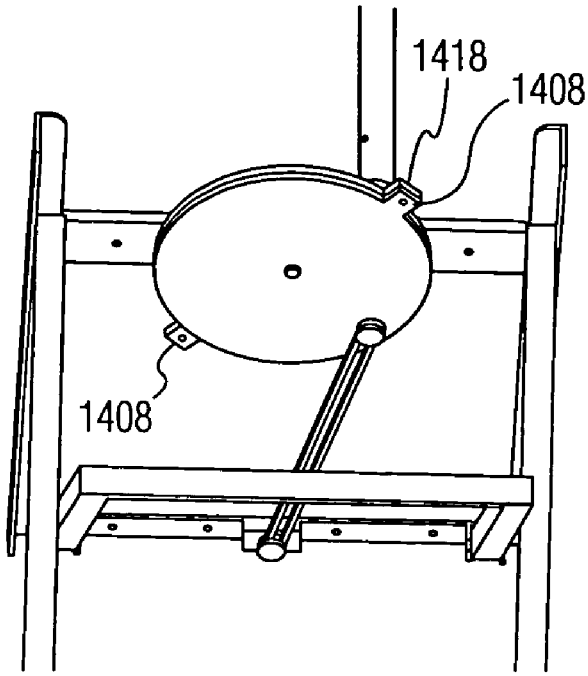
Figure 15E:
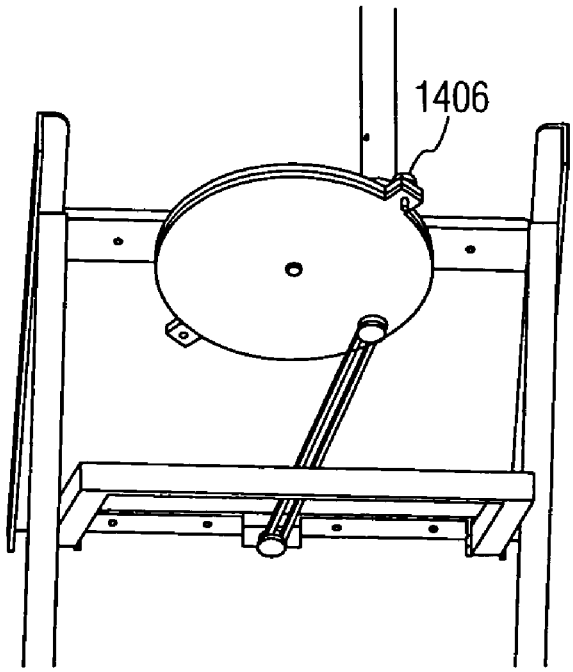

Once the desired number of repetitions in one orientation (either from 45 degrees of clockwise torso rotation to 45 degrees of counterclockwise torso rotation or from 45 degrees of counterclockwise torso rotation to 45 degrees of clockwise torso rotation) are accomplished, the resistance mechanism must be reset to allow positively resisted exercise in the other orientation. Referring to FIG. 15, the resetting to the opposite orientation of the resistance mechanism (1308) and rotational member (1306) of an elastic member resistance embodiment (1300) of the collapsible rotary torso exercise machine is shown. Referring to FIG. 15A, the resistance mechanism (1308) and rotational member (1306) as they are set for positively resisted exercise with the user turning towards his left (counterclockwise as seen from the top, clockwise as seen from the bottom) is shown. Referring to FIGS. 15B-15E, to reset the resistance mechanism, the plate alignment pin (1406) is first removed (FIG. 15B). The upper plate (1404) together with attached T-bar assembly (110) is then turned 90 degrees clockwise as seen from the bottom (counterclockwise as seen from the top) (FIG. 15C). The lower plate (1402) is then turned 90 degrees counterclockwise (as seen from the bottom, clockwise as seen from the top) until the plate alignment pin protrusions (1408, 1418) align again and the rear end of the elastic member (1308) is moved toward the other side of the machine (FIG. 15D). Finally the plate alignment pin (1406) is reinserted in the new orientation and the machine is now ready for positively resisted exercise in the opposite orientation (FIG. 15E).

The resistance characteristics of the elastic member resistance embodiment (1300) differ from resistance characteristics of the previous embodiments. Whereas in the hydraulic piston in cylinder (100) and friction resistance (1100) embodiments above, the resistance mechanism does not to exert any pressure against the user once the user stops the exercise motion (a pneumatic version of the piston in cylinder resistance mechanism will exert temporary pressure that subsides after motion stops), in the elastic member resistance embodiment (1300), the elastic member (1308) will exert more and more resistance against the user the further it is stretched and it will continue to exert pressure back towards the exercise starting position until the user returns the T-bar assembly (110) back to the exercise starting position. As a result, an added benefit when utilizing this elastic member resistance embodiment (1300) of the collapsible rotary torso exercise machine is that negative resistance exercise is available. If the user chooses to slowly return to the exercise starting position after completing the initial rotary motion against the elastic member resistance, negative resistance exercise is thus accomplished as the elastic member (1308) will continue to exert pressure but now in the same direction that the user is moving during the return to the exercise starting position for the currently selected orientation of exercise. Energy must therefore be expended by the user to slow the return to the starting position thus providing this different negative resistance exercise.

I claim:

1. A rotary torso exercise machine comprising a. a seat portion which remains stationary during the rotary torso exercise movement b. collapsible legs attached to said seat portion to support said seat portion c. a substantially horizontally rotating rotational member, which rotates about a substantially vertical axis and which functions as the pivot around which a rotary torso exercise motion is performed, connected to said seat portion d. a T-bar assembly attached to said rotational member, said T-bar assembly comprising a substantially horizontal bar portion and a substantially vertical post portion extending therefrom, the lower part of said vertical post portion being foldably or removably attached to said rotational member e. a resistance mechanism connected to said rotational member for resisting rotary motion of the assembly comprising said rotational member and said T-bar assembly.

2. The invention of claim 1 further comprising a mechanism for varying the amount of resistance offered by said resistance mechanism.

3. The invention of claim 1 where said resistance mechanism comprises a piston in cylinder assembly.

4. The invention of claim 3 further comprising a mechanism for varying the resistance of said resistance mechanism.

5. The invention of claim 3 further comprising an adjustable valve to regulate the flow of fluid from the interior of said cylinder on one side of said piston to the interior of said cylinder on the other side of said piston.

6. The invention of claim 1 where said resistance mechanism comprises a friction mechanism.

7. The invention of claim 6 further comprising a mechanism for varying the resistance of said resistance mechanism.

8. The invention of claim 1 where said resistance mechanism is a band brake.

9. The invention of claim 8 further comprising a mechanism for varying the resistance of said resistance mechanism.

10. The invention of claim 8 further comprising a threaded knob whose threads are engaged with a fastening member which holds the ends of the band of said band brake such that when said threaded knob is turned, the tension on the band of said band brake is changed.

11. The invention of claim 1 where said resistance mechanism comprises one or more elastic members.

12. The invention of claim 11 wherein the elastic members are interchangeable.

13. The invention of claim 11 where said rotational member comprises 2 stacked substantially disc-shaped plates held in relative rotational alignment to one another by a pin inserted through the surfaces of said plates and such that when said pin is removed, said plates may be rotated into a new alignment, said pin may be reinserted to hold said plates in said new alignment, thereby altering the orientation of exercise provided by said rotary torso exercise machine.

14. The invention of claim 1 where said exercise machine is foldable and collapsible to a height of 5 inches or less.

15. The invention of claim 1 where when said T-bar assembly is removed, the remainder of said exercise machine is foldable and collapsible to a height of 4.25 inches or less.

16. The invention of claim 1 further comprising padding disposed upon said T-bar assembly.

17. The invention of claim 1 where said rotational member is connected to the rear underside of said seat portion.

18. A rotary torso exercise machine comprising a. a seat portion which remains stationary during the rotary torso exercise movement b. collapsible legs c. a rotational member which rotates about a substantially vertical axis and which functions as the pivot around which a rotary torso exercise motion is performed, said rotary torso exercise comprising keeping the buttocks substantially stationary while twisting the torso around the substantially straight spine as axis d. a T-bar assembly comprising a substantially horizontal bar portion and a substantially vertical post portion extending therefrom, said vertical post portion being connected to said rotational member e. a resistance mechanism for resisting rotary motion of said rotational member and said T-bar assembly.

19. The invention of claim 18 where said exercise machine is foldable and collapsible to a height of 5 inches or less.

20. A rotary torso exercise machine comprising a. a seat portion which remains stationary during the rotary torso exercise movement b. collapsible legs attached to said seat portion to support said seat portion c. a substantially horizontally rotating rotational member, which rotates about a substantially vertical axis and which functions as the pivot around which a rotary torso exercise motion is performed, connected to said seat portion d. a T-bar assembly attached to said rotational member, said T-bar assembly comprising a substantially horizontal bar portion suitable to be grasped comfortably behind one's back in the crooks of both elbows simultaneously, and a substantially vertical post portion extending from said horizontal bar portion, the lower part of said vertical post portion being foldably or removably attached to said rotational member e. a resistance mechanism connected to said rotational member for resisting rotary motion of the assembly comprising said rotational member and said T-bar assembly.

* * * * *